US010808662B2

(12) United States Patent
Yamamoto et al.

(10) Patent No.: US 10,808,662 B2
(45) Date of Patent: Oct. 20, 2020

(54) FUEL INJECTION DEVICE

(71) Applicant: DENSO CORPORATION, Kariya, Aichi-pref. (JP)

(72) Inventors: Shinsuke Yamamoto, Kariya (JP); Shinobu Oikawa, Kariya (JP); Tomoji Matsukawa, Kariya (JP); Moriyasu Gotoh, Nishio (JP); Eiji Itoh, Kariya (JP)

(73) Assignee: DENSO CORPORATION, Kariya (JP)

( * ) Notice: Subject to any disclaimer, the term of this patent is extended or adjusted under 35 U.S.C. 154(b) by 117 days.

(21) Appl. No.: 15/755,726

(22) PCT Filed: Jun. 21, 2016

(86) PCT No.: PCT/JP2016/002970
§ 371 (c)(1),
(2) Date: Feb. 27, 2018

(87) PCT Pub. No.: WO2017/037973
PCT Pub. Date: Mar. 9, 2017

(65) Prior Publication Data

US 2019/0024618 A1 Jan. 24, 2019

(30) Foreign Application Priority Data

Sep. 2, 2015 (JP) ..... 2015-172929

(51) Int. Cl.
*F02M 51/06* (2006.01)
*F02M 61/16* (2006.01)
*F02M 61/18* (2006.01)

(52) U.S. Cl.
CPC .... *F02M 51/0664* (2013.01); *F02M 51/0607* (2013.01); *F02M 51/0689* (2013.01);
(Continued)

(58) Field of Classification Search
CPC ..... F02M 51/0664; F02M 51/0607; F02M 51/0689; F02M 51/06; F02M 51/0625;
(Continued)

(56) References Cited

U.S. PATENT DOCUMENTS

2009/0165750 A1* 7/2009 Tsuchiya ..... F02M 51/0603 123/476
2016/0097358 A1* 4/2016 Miyake ..... F02M 51/0671 239/585.1

FOREIGN PATENT DOCUMENTS

EP 2 570 648 3/2013

OTHER PUBLICATIONS

U.S. Appl. No. 15/749,909 of Oikawa et al., entitled "Fuel Injection Device", filed Feb. 2, 2018 (49 pages).
(Continued)

*Primary Examiner* — Tuongminh N Pham
(74) *Attorney, Agent, or Firm* — Nixon & Vanderhye P.C.

(57) ABSTRACT

An inner side wall surface of a gap forming member, which is opposed to a flange outer wall surface of a flange of a needle, is slidable relative to the flange outer wall surface. Also, an outer side wall surface of the gap forming member, which is opposed to a stationary core inner wall surface of a stationary core, is slidable relative to the stationary core inner wall surface. The flange outer wall surface and the outer side wall surface are curved to project in a radially outer direction of a housing in a cross section thereof taken along an imaginary plane, which includes an axis of the housing.

9 Claims, 13 Drawing Sheets

(52) U.S. Cl.
CPC ..... *F02M 61/161* (2013.01); *F02M 61/18* (2013.01); *F02M 51/06* (2013.01); *F02M 2200/502* (2013.01)

(58) Field of Classification Search
CPC ..... F02M 51/061; F02M 51/0653; F02M 51/0671; F02M 51/0675; F02M 51/0682; F02M 51/0685; F02M 61/161; F02M 61/18; F02M 61/10; F02M 61/20; F02M 2200/306; F02M 2200/50
See application file for complete search history.

(56) References Cited

OTHER PUBLICATIONS

U.S. Appl. No. 15/752,278 of Yamamoto et al., entitled "Fuel Injection Device", filed Feb. 13, 2018 (44 pages).

* cited by examiner

FUEL INJECTION DEVICE

CROSS REFERENCE TO RELATED APPLICATION

This application is the U.S. national phase of International Application No. PCT/2016/002970, filed on Jun. 21, 2016 which designated the U.S. and claims priority to Japanese Patent Application No. 2015-172929 filed on Sep. 2, 2015, the entire contents of each of which are hereby incorporated by reference.

TECHNICAL FIELD

The present disclosure relates to a fuel injection device that supplies fuel to an internal combustion engine.

BACKGROUND ART

Previously, there is known a fuel injection device that forms a gap in an axial direction between a movable core and a flange of a needle in such a manner that the movable core is accelerated in the gap and collides against the flange of the needle to implement valve opening of the needle. For example, the patent literature 1 discloses the fuel injection device that includes a gap forming member, which can form the gap in the axial direction between the movable core and the flange of the needle. In this fuel injection device, the movable core, which has an increased kinetic energy that is increased through the acceleration of the movable core in the gap, collides against the flange. Therefore, even though a fuel pressure in a fuel passage in an inside of a housing receiving the needle is high, the valve opening of the needle is possible. Thereby, the high pressure fuel can be injected.

In the fuel injection device of the patent literature 1, the gap forming member is shaped into a bottomed tubular form. An inner wall of a tubular portion of the gap forming member is slidable relative to an outer wall of the flange, and an outer wall of the tubular portion is slidable relative to an inner wall of the stationary core. In this way, reciprocation of the needle in an axial direction is guided. The needle is supported by the gap forming member and the stationary core only at one end part of the needle, which is opposite from a valve seat in the axial direction. Therefore, the orientation of the needle may possibly be changed such that an axis of the needle is tilted.

In the fuel injection device of the patent literature 1, the inner wall of the tubular portion of the gap forming member, the inner wall of the stationary core, and the outer wall of the gap forming member are respectively shaped in a form of a cylindrical surface, and the outer wall of the flange and the outer wall of the gap forming member may possibly make a surface-to-surface contact with the inner wall of the tubular portion of the gap forming member or the inner wall of the stationary core. Therefore, in a case where the orientation of the needle is changed to tilt the axis of the needle at the time of reciprocating the needle, a slide resistance between each corresponding adjacent two of the flange, the gap forming member and the stationary core may possibly be increased, or the slide surfaces of the flange, the gap forming member and the stationary core may possibly be unevenly worn. In this way, response of the needle may possibly be deteriorated, or reciprocation of the needle in the axial direction may possibly be unstabilized. Therefore, it may possibly cause variations in the injection amount of fuel injected from the fuel injection device. Furthermore, when wear debris is generated, the wear debris may possibly be caught between corresponding members, which make relative movement therebetween, to possibly cause an operational failure.

Furthermore, in the fuel injection device of the patent literature 1, outer peripheral edge corners of two opposite end parts of the flange, which are opposite to each other in the axial direction, are slidable relative to the inner wall of the tubular portion of the gap forming member. Furthermore, an outer peripheral edge corner of one of two opposite end parts of the gap forming member, which are opposite to each other in the axial direction, is slidable relative to the inner wall of the stationary core. Therefore, in the case where the orientation of the needle is changed such that the axis of the needle is tilted at the time of reciprocating the needle and the gap forming member in the axial direction, one of the outer peripheral edge corners of the flange may possibly be caught on the inner wall of the tubular portion of the gap forming member, or the outer peripheral edge corner of the gap forming member may possibly be caught on the inner wall of the stationary core. Thereby, an operational failure of the needle may possibly occur.

CITATION LIST

Patent Literature

PATENT LITERATURE 1: JP2014-227958A

SUMMARY OF INVENTION

The present disclosure is made in view of the above disadvantage, and it is an objective of the present disclosure to provide a fuel injection device that can inject high pressure fuel and can limit variations in the injection amount of fuel and an operational failure of a needle.

A first fuel injection device of the present disclosure includes a nozzle, a housing, a needle, a movable core, a stationary core, a gap forming member, a valve seat side urging member and a coil.

The nozzle has an injection hole, through which fuel is injected, and a valve seat, which is formed around the injection hole and is shaped into a ring form.

The housing is shaped into a tubular form and has one end connected to the nozzle. The housing has a fuel passage, which is formed in an inside of the housing and is communicated with the injection hole.

The needle has: a needle main body, which is shaped into a rod form; a seal portion, which is formed at one end of the needle main body such that the seal portion is contactable with the valve seat; and a flange, which is shaped into a ring form and is formed on a radially outer side of the needle main body. The needle is installed such that the needle is reciprocatable in the fuel passage, and when the seal portion is lifted away from or is seated against the valve seat, the needle opens or closes the injection hole.

The movable core is installed such that the movable core is movable relative to the needle main body and has a surface, which is opposite from the valve seat and is contactable with a surface of the flange located on the valve seat side of the flange.

The stationary core is shaped into a tubular form and is installed on an opposite side of the movable core, which is opposite from the valve seat, in the inside of the housing such that the stationary core is coaxial with the housing.

The gap forming member has: a plate portion that is placed on the opposite side of the needle, which is opposite from the valve seat, in an inside of the stationary core such that one end surface of the plate portion is contactable with the needle; and an extending portion that is formed to extend in a tubular form from the plate portion toward the valve seat, while an opposite end part of the extending portion, which is opposite from the plate portion, is contactable with the surface of the movable core located on the stationary core side of the movable core. The gap forming member is operable to form an axial gap, which is a gap defined in an axial direction between the flange and the movable core, when the plate portion and the extending portion are in contact with the needle and the movable core, respectively.

The valve seat side urging member is placed on the opposite side of the gap forming member, which is opposite from the valve seat. The valve seat side urging member is operable to urge the needle and the movable core toward the valve seat through the gap forming member.

The coil is operable to attract the movable core toward the stationary core such that the movable core contacts the flange and drives the needle toward the opposite side, which is opposite from the valve seat, when the coil is energized.

In the first fuel injection device of the present disclosure, as discussed above, the gap forming member is operable to form the axial gap between the flange and the movable core when the plate portion and the extending portion are in contact with the needle and the movable core, respectively. Therefore, at the time of magnetically attracting the movable core toward the stationary core through the energization of the coil, the movable core can collide against the flange after accelerating the movable core in the axial gap. In this way, the movable core, which has the increased kinetic energy through the acceleration of the movable core in the axial gap, can collide against the flange. Therefore, even when the fuel pressure in the fuel passage is high, the valve opening of the needle is possible. Thus, the high pressure fuel can be injected.

Furthermore, in the fuel injection device of the present disclosure, the flange has a flange outer wall surface at an outer wall of the flange located on a radially outer side of the flange. The stationary core has a stationary core inner wall surface at an inner wall of the stationary core located on a radially inner side of the stationary core. The gap forming member is formed such that an inner side wall surface of the gap forming member, which is a wall surface opposed to the flange outer wall surface, is slidable relative to the flange outer wall surface, and an outer side wall surface of the gap forming member, which is a wall surface opposed to the stationary core inner wall surface, is slidable relative to the stationary core inner wall surface.

At least one of the flange outer wall surface or the outer side wall surface is curved to project in a radially outer direction of the housing in a cross section of the at least one of the flange outer wall surface or the outer side wall surface taken along an imaginary plane, which includes an axis of the housing. That is, the at last one of the flange outer wall surface or the outer side wall surface is formed to curve in the axial direction. Therefore, the at least one of the flange outer wall surface or the outer side wall surface can make a line contact with the inner side wall surface or the stationary core inner wall surface. Thus, even in the case where the orientation of the needle is changed to tilt the axis of the needle at the time of reciprocating the needle, it is possible to limit an increase in a slide resistance between each corresponding adjacent two of the flange, the gap forming member and the stationary core, and it is also possible to limit uneven wearing of the corresponding slide surfaces of the flange, the gap forming member and/or the stationary core. In this way, it is possible to limit the deterioration of the response of the needle, and it is possible to limit the unstable reciprocation of the needle in the axial direction. Thus, it is possible to limit variations in the injection amount of fuel, which is injected from the fuel injection device. Furthermore, it is possible to limit generation of wear debris. Thus, it is possible to limit the operational failure that is caused by clamping of the wear debris between members, which make relative movement therebetween.

Furthermore, in the first fuel injection device of the present disclosure, at least one of the flange or the gap forming member can be constructed such that outer peripheral edge corners of axial end parts of the at least one of the flange or the gap forming member do not slide relative to the inner side wall surface of the gap forming member or the stationary core inner wall surface of the stationary core. Therefore, even in the case where the orientation of the needle is changed to tilt the axis of the needle at the time of reciprocating the needle and the gap forming member in the axial direction, it is possible to limit catching of the edge corners of the flange by the inner side wall surface of the gap forming member and catching of the edge corner of the gap forming member by the stationary core inner wall surface of the stationary core. In this way, it is possible to limit the operational failure of the needle.

In a second fuel injection device of the present disclosure, at least one of the inner side wall surface or the stationary core inner wall surface is curved to project in a radially inner direction of the housing in a cross section of the at least one of the inner side wall surface or the stationary core inner wall surface taken along an imaginary plane, which includes an axis of the housing. That is, the at last one of the inner side wall surface or the stationary core inner wall surface is formed to curve in the axial direction. Therefore, the at least one of the inner side wall surface or the stationary core inner wall surface can make a line contact with the flange outer wall surface or the outer side wall surface. Thus, even in the case where the orientation of the needle is changed to tilt the axis of the needle at the time of reciprocating the needle, it is possible to limit an increase in a slide resistance between each corresponding adjacent two of the flange, the gap forming member and the stationary core, and it is also possible to limit uneven wearing of the corresponding slide surfaces of the flange, the gap forming member and/or the stationary core. In this way, it is possible to limit the deterioration of the response of the needle, and it is possible to limit the unstable reciprocation of the needle in the axial direction. Thus, it is possible to limit variations in the injection amount of fuel, which is injected from the fuel injection device. Furthermore, it is possible to limit generation of wear debris. Thus, it is possible to limit the operational failure that is caused by clamping of the wear debris between members, which make relative movement therebetween.

Furthermore, in the second fuel injection device, similar to the first fuel injection device, at least one of the flange or the gap forming member can be constructed such that outer peripheral edge corners of axial end parts of the at least one of the flange or the gap forming member do not slide relative to the inner side wall surface of the gap forming member or the stationary core inner wall surface of the stationary core. In this way, it is possible to limit the operational failure of the needle.

In a third fuel injection device of the present disclosure, the flange outer wall surface is curved to project in a radially outer direction of the housing in a cross section of the flange outer wall surface taken along an imaginary plane, which includes an axis of the housing. The stationary core inner wall surface is curved to project in a radially inner direction of the housing in a cross section of the stationary core inner wall surface taken along the imaginary plane. That is, each of the flange outer wall surface and the stationary core inner wall surface is curved in the axial direction. Therefore, the flange outer wall surface and the stationary core inner wall surface can make a line contact with the inner side wall surface or the outer side wall surface. Thus, even in the case where the orientation of the needle is changed to tilt the axis of the needle at the time of reciprocating the needle, it is possible to limit an increase in a slide resistance between each corresponding adjacent two of the flange, the gap forming member and the stationary core, and it is also possible to limit uneven wearing of the slide surfaces of the flange, the gap forming member and the stationary core. In this way, it is possible to limit the deterioration of the response of the needle, and it is possible to limit the unstable reciprocation of the needle in the axial direction. Thus, it is possible to limit variations in the injection amount of fuel, which is injected from the fuel injection device. Furthermore, it is possible to limit generation of wear debris. Thus, it is possible to limit the operational failure that is caused by clamping of the wear debris between members, which make relative movement therebetween.

Furthermore, in the third fuel injection device of the present disclosure, each of the flange and the gap forming member can be constructed such that outer peripheral edge corners of axial end parts of each of the flange and the gap forming member do not slide relative to the inner side wall surface of the gap forming member or the stationary core inner wall surface of the stationary core. Therefore, even in the case where the orientation of the needle is changed to tilt the axis of the needle at the time of reciprocating the needle and the gap forming member in the axial direction, it is possible to limit catching of the edge corners of the flange by the inner side wall surface of the gap forming member and catching of the edge corner of the gap forming member by the stationary core inner wall surface of the stationary core. In this way, it is possible to limit the operational failure of the needle.

In a fourth fuel injection device of the present disclosure, the inner side wall surface of the gap forming member is curved to project in a radially inner direction of the housing in a cross section of the inner side wall surface taken along an imaginary plane, which includes the axis of the housing. The outer side wall surface of the gap forming member is curved to project in a radially outer direction of the housing in a cross section of the outer side wall surface taken along the imaginary plane. That is, each of the inner side wall surface and the outer side wall surface is curved in the axial direction. Therefore, each of the inner side wall surface and the outer side wall surface can make a line contact with the flange outer wall surface or the stationary core inner wall surface. Thus, even in the case where the orientation of the needle is changed to tilt the axis of the needle at the time of reciprocating the needle, it is possible to limit an increase in a slide resistance between each corresponding adjacent two of the flange, the gap forming member and the stationary core, and it is also possible to limit uneven wearing of the corresponding slide surfaces of the flange, the gap forming member and the stationary core. In this way, it is possible to limit the deterioration of the response of the needle, and it is possible to limit the unstable reciprocation of the needle in the axial direction. Thus, it is possible to limit variations in the injection amount of fuel, which is injected from the fuel injection device. Furthermore, it is possible to limit generation of wear debris. Thus, it is possible to limit the operational failure that is caused by clamping of the wear debris between members, which make relative movement therebetween.

Furthermore, in the fourth fuel injection device of the present disclosure, similar to the third fuel injection device, each of the flange and the gap forming member can be constructed such that outer peripheral edge corners of axial end parts of each of the flange and the gap forming member do not slide relative to the inner side wall surface of the gap forming member or the stationary core inner wall surface of the stationary core. In this way, it is possible to limit the operational failure of the needle.

DESCRIPTION OF EMBODIMENTS

Hereinafter, various embodiments of the present disclosure will be described with reference to the accompanying drawings. In the following embodiments, substantially identical structural portions will be indicated by the same reference signs and will not be redundantly described for the sake of simplicity.

First Embodiment

Figure 1:
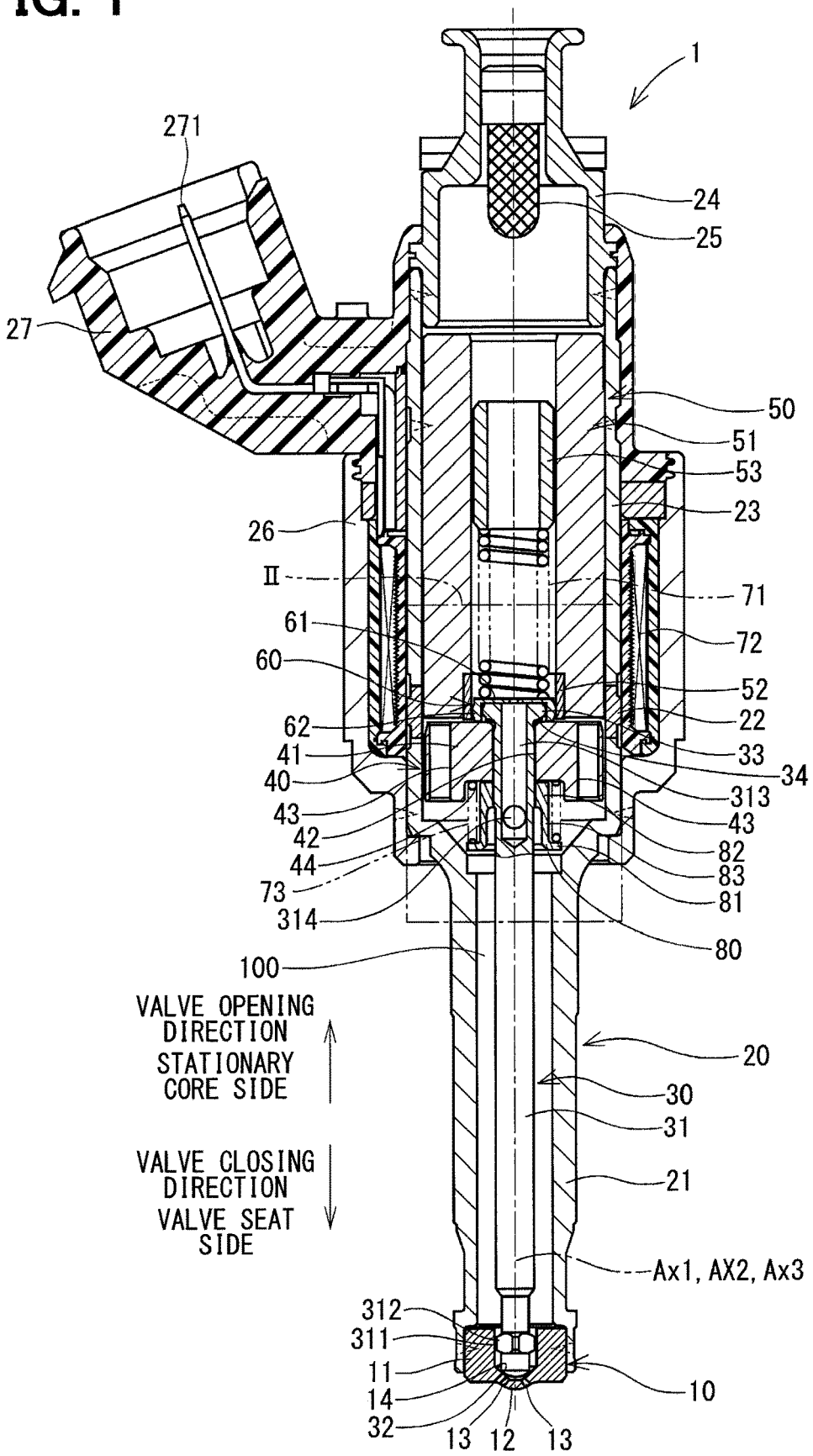
FIG. 1 is a cross-sectional view showing a fuel injection device according to a first embodiment of the present disclosure.

FIG. 1 shows a fuel injection device (a fuel injection valve) according to a first embodiment of the present disclosure. The fuel injection device 1 is used in, for example, an undepicted direct injection type gasoline engine (serving as an internal combustion engine) and injects gasoline as fuel in the engine.

The fuel injection device 1 includes a nozzle 10, a housing 20, a needle 30, a movable core 40, a stationary core 50, a gap forming member 60, a spring (serving as a valve seat side urging member) 71 and a coil 72.

The nozzle 10 is made of a material, such as martensitic stainless steel, which has a relatively high hardness. The nozzle 10 is quenched to have a predetermined hardness. The nozzle 10 includes a nozzle tubular portion 11 and a nozzle bottom portion 12 while the nozzle bottom portion 12 closes one end of the nozzle tubular portion 11. The nozzle bottom portion 12 has a plurality of injection holes 13, each of which connects between an inner surface of the nozzle bottom portion 12, which is located on the nozzle tubular portion 11 side, and an opposite surface of the nozzle bottom portion 12, which is opposite from the nozzle tubular portion 11. The inner surface of the nozzle bottom portion 12, which is located on the nozzle tubular portion 11 side, has a valve seat 14, which is formed around the injection holes 13 and is shaped into a ring form.

The housing 20 includes a first tubular portion 21, a second tubular portion 22, a third tubular portion 23, an inlet portion 24 and a filter 25.

The first tubular portion 21, the second tubular portion 22 and the third tubular portion 23 are respectively shaped into a generally cylindrical tubular form. The first tubular portion 21, the second tubular portion 22 and the third tubular portion 23 are arranged one after another in this order to share a common axis (an axis Ax1) and are joined together.

The first tubular portion 21 and the third tubular portion 23 are made of a magnetic material, such as ferritic stainless steel, and are magnetically stabilized through a magnetic stabilization process. The first tubular portion 21 and the third tubular portion 23 have a relatively low hardness. In contrast, the second tubular portion 22 is made of a non-magnetic material, such as austenitic stainless steel. A hardness of the second tubular portion 22 is higher than the hardness of the first tubular portion 21 and the third tubular portion 23.

An end part of the nozzle tubular portion 11, which is opposite from the nozzle bottom portion 12, is joined to an inside of an end part of the first tubular portion 21, which is opposite from the second tubular portion 22. The first tubular portion 21 and the nozzle 10 are joined together by, for example, welding.

The inlet portion 24 is shaped into a tubular form and is made of metal, such as stainless steel. One end of the inlet portion 24 is joined to an inside of an end part of the third tubular portion 23, which is opposite from the second tubular portion 22. The inlet portion 24 and the third tubular portion 23 are joined together by, for example, welding.

A fuel passage 100 is formed in an inside of the housing 20 and the nozzle tubular portion 11. The fuel passage 100 is connected to the injection holes 13. A pipe (not shown) is connected to an opposite side of the inlet portion 24, which is opposite from the third tubular portion 23. In this way, the fuel, which is supplied from a fuel supply source, flows into the fuel passage 100 through the pipe. The fuel passage 100 guides the fuel to the injection holes 13.

The filter 25 is placed in an inside of the inlet portion 24. The filter 25 captures foreign objects contained in the fuel, which flows into the fuel passage 100.

The needle 30 is made of a material, such as martensitic stainless steel, which has a relatively high hardness. The needle 30 is quenched to have a predetermined hardness. The hardness of the needle 30 is set to be substantially the same as the hardness of the nozzle 10.

The needle 30 is received in the inside of the housing 20 in a manner that enables reciprocation of the needle 30 in the axial direction of the axis Ax1 of the housing 20 in the fuel passage 100. The needle 30 includes a needle main body 31, a seal portion 32 and a flange 33.

The needle main body 31 is shaped into a rod form, more specifically, an elongated cylindrical form. The seal portion 32 is formed at one end of the needle main body 31, that is, the seal portion 32 is formed at a valve seat 14 side end part of the needle main body 31. The seal portion 32 is contactable with the valve seat 14. The flange 33 is shaped into a generally ring form and is formed at the other end of the needle main body 31, that is, the flange 33 is formed at a radially outer side of an opposite end part of the needle main body 31, which is opposite from the valve seat 14. In the present embodiment, the flange 33 is formed integrally with the needle main body 31 in one piece.

A large diameter portion 311 is formed at a location that is around the one end of the needle main body 31. An outer diameter of one end side of the needle main body 31 is smaller than an outer diameter of the other end side of the needle main body 31. The outer diameter of the large diameter portion 311 is larger than the outer diameter of the one end side of the needle main body 31. The large diameter portion 311 is formed such that an outer wall of the large diameter portion 311 is slidable relative to an inner wall of the nozzle tubular portion 11 of the nozzle 10. In this way, reciprocation of the valve seat 14 side end part of the needle 30 in the axial direction of the axis Ax1 is guided. The large diameter portion 311 has chamfered portions 312 that are formed by chamfering a plurality of circumferential parts of the outer wall of the large diameter portion 311. Thereby, the fuel can flow through gaps, each of which is formed between a corresponding one of the chamfered portions 312 and the inner wall of the nozzle tubular portion 11.

Figure 2:
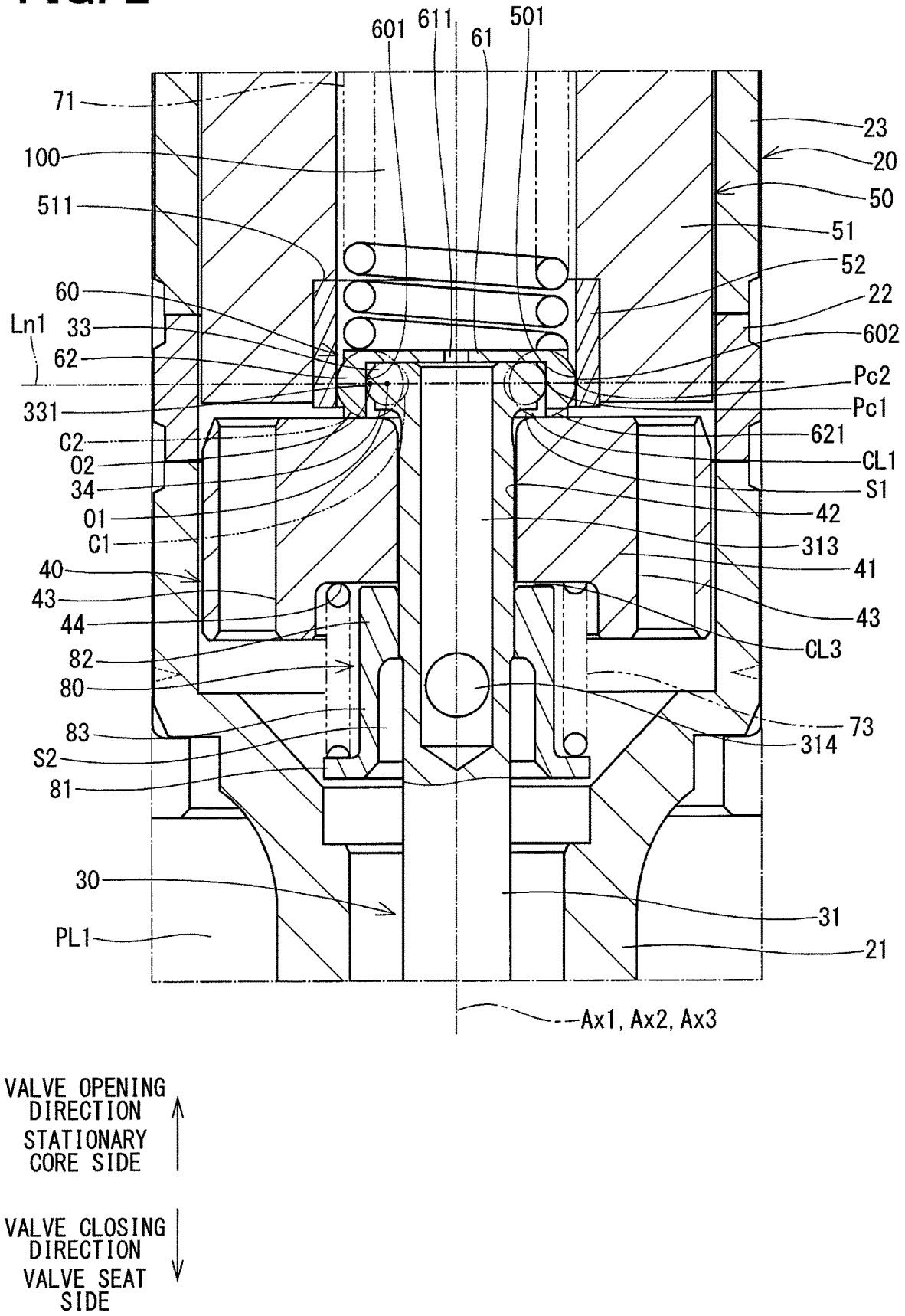
FIG. 2 is a cross-sectional view showing a movable core and its adjacent area in the fuel injection device according to the first embodiment of the present disclosure at a time of contacting a needle to a valve seat.

As shown in FIG. 2, an axial hole 313, which extends along an axis Ax2 of the needle main body 31, is formed at the other end of the needle main body 31. That is, the other end of the needle main body 31 is shaped into a hollow tubular form. Furthermore, the needle main body 31 has radial holes 314, each of which extends in a radial direction of the needle main body 31 such that the radial hole 314 communicates between a valve seat 14 side end part of the axial hole 313 and a space located at the outside of the needle main body 31. Thereby, the fuel in the fuel passage 100 can flow through the axial hole 313 and the radial holes 314. As discussed above, the needle main body 31 has the axial hole 313. The axial hole 313 extends in the axial direction of the axis Ax2 from an opposite end surface of the needle main body 31, which is opposite from the valve seat 14, and the axial hole 313 is communicated with the space outside of the needle main body 31 through the radial holes 314.

When the seal portion 32 of the needle 30 moves away (is lifted) from the valve seat 14 or contacts (is seated against) the valve seat 14, the needle 30 opens or closes the injection holes 13. Hereinafter, a direction of moving the needle 30 away from the valve seat 14 will be referred to as a valve opening direction, and a direction of moving the needle 30 toward and contacting the needle 30 with the valve seat 14 will be referred to as a valve closing direction.

The movable core 40 includes a movable core main body 41, an axial hole 42, through-holes 43 and a recess 44. The movable core main body 41 is shaped into a generally cylindrical form and is made of a magnetic material, such as ferritic stainless steel. The movable core main body 41 is magnetically stabilized through a magnetic stabilization process. A hardness of the movable core main body 41 is relatively low and is substantially the same as the hardness of the first tubular portion 21 and the third tubular portion 23 of the housing 20.

The axial hole 42 extends along an axis Ax3 of the movable core main body 41. In the present embodiment, an inner wall of the axial hole 42 is processed through a hardening process (e.g., Ni—P plating) and a slide resistance reducing process. The through-holes 43 are formed to connect between one end surface of the movable core main body 41, which is located on the valve seat 14 side, and an opposite end surface of the movable core main body 41, which is opposite from the valve seat 14. Each of the through-holes 43 has a cylindrical inner wall. In the present embodiment, the number of the through-holes 43 is four, and these through-holes 43 are arranged one after another at equal intervals in the circumferential direction of the movable core main body 41.

The recess 44 is formed at a center of the movable core main body 41 such that the recess 44 is circular and is recessed from the end surface of the movable core main body 41, which is located on the valve seat 14 side, toward the opposite side that is opposite from the valve seat 14. The axial hole 42 opens at a bottom of the recess 44.

The movable core 40 is received in the housing 20 in a state where the needle main body 31 of the needle 30 is inserted through the axial hole 42 of the movable core 40. An inner diameter of the axial hole 42 of the movable core 40 is set to be equal to or slightly larger than the outer diameter of the needle main body 31 of the needle 30. Therefore, the movable core 40 is movable relative to the needle 30 such that the inner wall of the axial hole 42 of the movable core 40 is slid relative to an outer wall of the needle main body 31 of the needle 30. Similar to the needle 30, the movable core 40 is received in the inside of the housing 20 in a manner that enables reciprocation of the movable core 40 in the axial direction Ax1 of the housing 20 in the fuel passage 100. The fuel in the fuel passage 100 can flow through the through-holes 43.

In the present embodiment, a surface of the movable core main body 41, which is opposite from the valve seat 14, is processed through a hardening process (e.g., hard chrome plating) and an anti-abrasion process.

An outer diameter of the movable core main body 41 is set to be smaller than inner diameters of the first tubular portion 21 and the second tubular portion 22 of the housing 20. Therefore, when the movable core 40 is reciprocated in the fuel passage 100, an outer wall of the movable core 40 is not slid relative to an inner wall of the first tubular portion 21 and an inner wall of the second tubular portion 22.

A surface of the flange 33 of the needle 30, which is located on the valve seat 14 side, is contactable with the surface of the movable core main body 41, which is located on the side that is opposite from the valve seat 14. That is, the needle 30 has a contact surface 34 that is contactable with the surface of the movable core main body 41, which is located on the side that is opposite from the valve seat 14. The movable core 40 is formed such that the movable core 40 is movable relative to the needle 30 in such a manner that the movable core 40 is contactable with the contact surface 34 or is movable away from the contact surface 34.

With respect to the movable core 40 placed in the inside of the housing 20, the stationary core 50 is coaxial with the housing 20 and is located on the opposite side of the movable core 40, which is opposite from the valve seat 14. The stationary core 50 includes a stationary core main body 51 and a bush 52. The stationary core main body 51 is shaped into a generally cylindrical tubular form and is made of a magnetic material, such as ferritic stainless steel. The stationary core main body 51 is magnetically stabilized through a magnetic stabilization process. A hardness of the stationary core main body 51 is relatively low and is substantially the same as the hardness of the movable core main body 41. The stationary core main body 51 is fixed to the inner side of the housing 20. The stationary core main body 51 and the third tubular portion 23 of the housing 20 are welded together.

The bush 52 is shaped into a generally cylindrical tubular form and is made of a material, such as martensitic stainless steel, which has a relatively high hardness. The bush 52 is installed to a recess 511 that is radially outwardly recessed from an inner wall of a valve seat 14 side end part of the stationary core main body 51. An inner diameter of the bush 52 is generally the same as an inner diameter of the stationary core main body 51. An end surface of the bush 52, which is located on the valve seat 14 side, is placed on the valve seat 14 side of an end surface of the stationary core main body 51, which is located on the valve seat 14 side. Therefore, the surface of the movable core main body 41, which is opposite from the valve seat 14, is contactable with the end surface of the bush 52, which is located on the valve seat 14 side.

The stationary core 50 is formed such that in the state where the seal portion 32 contacts the valve seat 14, the flange 33 of the needle 30 is placed in the inside of the bush 52. An adjusting pipe 53, which is shaped into a cylindrical tubular form, is press fitted to an inner side of the stationary core main body 51 (see FIG. 1).

The gap forming member 60 is made of, for example, a non-magnetic material. A hardness of the gap forming member 60 is set to be generally the same as the hardness of the needle 30 and the hardness of the bush 52.

The gap forming member 60 is placed on the opposite side of the needle 30 and the movable core 40, which is opposite from the valve seat 14. The gap forming member 60 includes a plate portion 61 and an extending portion 62. The plate portion 61 is shaped into a generally circular plate form. The plate portion 61 is placed on the opposite side of the needle 30, which is opposite from the valve seat 14, in the inside of the stationary core 50 such that one end surface of the plate portion 61 is contactable with the needle 30, more specifically, an end surface of the needle main body 31, which is opposite from the valve seat 14, and an end surface of the flange 33 of the needle 30, which is opposite from the valve seat 14.

The extending portion 62 is formed integrally with the plate portion 61 in one piece such that the extending portion 62 is shaped into a generally cylindrical tubular form and extends from an outer peripheral edge part of the one end surface of the plate portion 61 toward the valve seat 14. That is, in the present embodiment, the gap forming member 60 is shaped into a bottomed cylindrical tubular form. The gap forming member 60 is placed such that the flange 33 of the needle 30 is placed in the inside of the extending portion 62. Furthermore, an end part of the extending portion 62, which is opposite from the plate portion 61, is contactable with the surface of the movable core main body 41, which is located on the stationary core 50 side.

In the present embodiment, the extending portion 62 is formed such that an axial length of the extending portion 62 is larger than an axial length of the flange 33. Therefore, in a state where the plate portion 61 contacts the needle 30, and the extending portion 62 contacts the movable core 40, the gap forming member 60 can form an axial gap CL1, which is a gap in the axial direction of the axis Ax1, between the flange 33 and the movable core 40.

The gap forming member 60 is movable relative to the needle 30 and the stationary core 50 (the bush 52) in the axial direction.

In the present embodiment, the flange 33 has a flange outer wall surface 331 at an outer wall of the flange 33 located on the radially outer side of the flange 33. The bush 52 of the stationary core 50 has a stationary core inner wall surface 501 at an inner wall of the bush 52 located on the radially inner side of the bush 52. In the present embodiment, the flange outer wall surface 331 is formed at a corresponding axial part of the outer wall of the flange 33 located on the radially outer side of the flange 33. The stationary core inner wall surface 501 is formed at a corresponding axial part of the inner wall of the bush 52 of the stationary core 50 located on the radially inner side of the bush 52.

An inner side wall surface 601 of the gap forming member 60, which is a wall surface of the gap forming member 60 opposed to the flange outer wall surface 331, is slidable relative to the flange outer wall surface 331. Also, an outer side wall surface 602 of the gap forming member 60, which is a wall surface of the gap forming member 60 opposed to the stationary core inner wall surface 501, is slidable relative to the stationary core inner wall surface 501. Thereby, the end part of the needle 30, which is located on the stationary core 50 side, is reciprocatably supported by the gap forming member 60 and the stationary core 50. In the present embodiment, the inner side wall surface 601 is formed at a corresponding axial part of the inner wall of the tubular portion 83 of the gap forming member 60 located on the radially inner side such that the inner side wall surface 601 is opposed to the flange outer wall surface 331. Furthermore, the outer side wall surface 602 is formed at a corresponding axial part of the outer wall of the gap forming member 60 located on the radially outer side such that the outer side wall surface 602 is opposed to the stationary core inner wall surface 501.

In the present embodiment, the valve seat 14 side end part of the needle 30 is reciprocatably supported by the inner wall of the nozzle tubular portion 11 of the nozzle 10, and the stationary core 50 side end part of the needle 30 is reciprocatably supported by the gap forming member 60 and the stationary core 50. As discussed above, the reciprocation of the needle 30 in the axial direction is guided at the two locations that are placed one after another in the axial direction of the axis Ax1 of the housing 20.

Each of the flange outer wall surface 331 and the outer side wall surface 602 is curved to project in the radially outer direction of the housing 20 in a cross section of each of the flange outer wall surface 331 and the outer side wall surface 602 taken along an imaginary plane PL1, which includes an axis Ax1 of the housing 20 (see FIG. 2). That is, the flange outer wall surface 331 is shaped in a form of a curved surface that is curved in the axial direction to project relative to the inner side wall surface 601. Furthermore, the outer side wall surface 602 is shaped in a form of a curved surface that is curved in the axial direction to project relative to the stationary core inner wall surface 501. In contrast, the inner side wall surface 601 and the stationary core inner wall surface 501 are respectively shaped in a form of a cylindrical surface.

Furthermore, in the present embodiment, the flange outer wall surface 331 is formed to extend along a portion of a first imaginary circle C1 in the imaginary plane PL1. The outer side wall surface 602 is formed to extend along a portion of a second imaginary circle C2 in the imaginary plane PL1. A center O1 of the first imaginary circle C1 and a center O2 of the second imaginary circle C2 are located along an imaginary straight line Ln1, which is perpendicular to the axis Ax1 of the housing 20, when the plate portion 61 is in contact with the needle 30 (see FIG. 2).

Because of the above construction, it may be said that the flange outer wall surface 331 and the outer side wall surface 602 are formed such that a maximum outer diameter part Pc1 of the flange outer wall surface 331, which has a maximum outer diameter in the flange outer wall surface 331, and a maximum outer diameter part Pc2 of the outer side wall surface 602, which has a maximum outer diameter in the outer side wall surface 602, are located along the imaginary straight line Ln1 when the plate portion 61 is in contact with the needle 30 (see FIG. 2).

In the present embodiment, a diameter of the first imaginary circle C1 is smaller than a diameter of the second imaginary circle C2. The center O1 of the first imaginary circle C1 and the center O2 of the second imaginary circle C2 are located on the radially outer side of the axis Ax1 of the housing 20. More specifically, the center O1 and the center O2 are located at the flange 33 (see FIG. 2).

Furthermore, in the present embodiment, the flange outer wall surface 331 and the outer side wall surface 602 are formed by, for example, cutting.

In the present embodiment, since the extending portion 62 is shaped into the tubular form, an annular space S1 (a space shaped into an annular form) is formed by the contact surface 34 of the flange 33, the movable core 40 and the inner wall of the extending portion 62 in the state where the extending portion 62 and the movable core 40 contact with each other.

The gap forming member 60 further includes a hole 611. The hole 611 connects between the one end surface of the plate portion 61 and the other end surface of the plate portion 61 and is communicatable with the axial hole 313 of the needle 30. Therefore, the fuel, which is located on the opposite side of the gap forming member 60 that is opposite from the valve seat 14 in the fuel passage 100, can flow to the valve seat 14 side of the movable core 40 through the hole 611, the axial hole 313 of the needle 30, and the radial holes 314 of the needle 30. An inner diameter of the hole 611 is smaller than the inner diameter of the bush 52 and an inner diameter of the axial hole 313. Therefore, when the needle 30 is moved together with the gap forming member 60 to the opposite side, which is opposite from the valve seat 14, i.e., when the needle 30 is moved in the valve opening direction, the fuel, which is located on the opposite side of the gap forming member 60 that is opposite from the valve seat 14, flows into the axial hole 313 after a flow of the fuel is restricted through the hole 611. In this way, it is possible to limit an excessive increase in the moving speed of the needle 30 in the valve opening direction.

The spring 71 is, for example, a coil spring and is placed on the opposite side of the gap forming member 60, which is opposite from the valve seat 14. One end of the spring 71 contacts the end surface of the plate portion 61 of the gap forming member 60, which is opposite from the extending portion 62. The other end of the spring 71 contacts the adjusting pipe 53. The spring 71 urges the gap forming member 60 toward the valve seat 14. In the state where the plate portion 61 of the gap forming member 60 contacts the needle 30, the spring 71 can urge the needle 30 toward the valve seat 14, i.e., in the valve closing direction through the gap forming member 60. Furthermore, in the state where the extending portion 62 of the gap forming member 60 contacts the movable core 40, the spring 71 can urge the movable core 40 toward the valve seat 14 through the gap forming member 60. That is, the spring 71 can urge the needle 30 and the movable core 40 toward the valve seat 14 through the gap forming member 60. An urging force of the spring 71 is adjusted by adjusting a location of the adjusting pipe 53 relative to the stationary core 50.

The coil 72 is shaped into a generally cylindrical tubular form and is arranged such that the coil 72 surrounds a radially outer side of the housing 20, particularly, a radially outer side of the second tubular portion 22 and the third tubular portion 23. When the coil 72 receives (energized with) an electric power, the coil 72 generates a magnetic force. When the coil 72 generates the magnetic force, the stationary core main body 51, the movable core main body 41, the first tubular portion 21 and the third tubular portion 23 form a magnetic circuit. In this way, a magnetic attractive force is generated between the stationary core main body 51 and the movable core main body 41, so that the movable core 40 is magnetically attracted to the stationary core 50 side. At this time, the movable core 40 is moved in the valve opening direction while the movable core 40 is accelerated in the axial gap CL1, and thereafter the movable core 40 collides against the contact surface 34 of the flange 33 of the needle 30. Therefore, the needle 30 is moved in the valve opening direction, so that the seal portion 32 is moved away from the valve seat 14, thereby resulting in the valve opening of the needle 30. As a result, the injection holes 13 are opened. As discussed above, when the coil 72 is energized, the movable core 40 is magnetically attracted to the stationary core 50 side, and thereby the movable core 40 contacts the flange 33 and moves the needle 30 toward the opposite side that is opposite from the valve seat 14.

As discussed above, according to the present embodiment, in the valve closing state, the gap forming member 60 forms the axial gap CL1 between the flange 33 and the movable core 40. Therefore, at the time of energizing the coil 72, the movable core 40 can collide with the flange 33 after acceleration of the movable core 40 in the axial gap CL1. In this way, even in a case where the pressure in the fuel passage 100 is relatively high, the valve opening is possible without increasing the electric power supplied to the coil 72.

When the movable core 40 is magnetically attracted toward the stationary core 50 (in the valve opening direction) by the magnetic attractive force, the end surface of the movable core main body 41, which is located on the stationary core 50 side, collides with the end surface of the bush 52, which is located on the valve seat 14 side. In this way, the movement of the movable core 40 in the valve opening direction is limited.

As shown in FIG. 1, a radially outer side of the inlet portion 24 and a radially outer side of the third tubular portion 23 are molded with resin. A connector 27 is formed at this molded portion. Terminals 271, which supply the electric power to the coil 72, are insert molded in the connector 27. A holder 26, which is shaped into a tubular form, is placed on a radially outer side of the coil 72 such that the holder 26 covers the coil 72.

In the present embodiment, the fuel injection device 1 includes a spring seat 81, a fixing portion 82, a tubular portion 83 and a spring (serving as a stationary core side urging member) 73.

The spring seat 81 and the fixing portion 82 are joined together through the tubular portion 83. The spring seat 81, the fixing portion 82 and the tubular portion 83 are made of metal, such as stainless steel, and are formed integrally in one piece. In the following description of the present embodiment, a member, in which the spring seat 81, the fixing portion 82 and the tubular portion 83 are formed integrally in one piece, will be also referred to as a specific member 80. That is, the specific member 80 includes the spring seat 81, the fixing portion 82 and the tubular portion 83. A hardness of the specific member 80 is set to be lower than the hardness of the needle 30.

The spring seat 81 is shaped into an circular ring plate form and is placed on the valve seat 14 side of the movable core 40 at a location that is on the radially outer side of the needle main body 31.

The fixing portion 82 is shaped into a circular ring form and is placed between the movable core 40, which is located on one side of the fixing portion 82, and the spring seat 81 and the radial hole 314, which are located on the other side of the fixing portion 82, at a location that is on the radially outer side of the needle main body 31. An inner wall of the fixing portion 82 is fitted to the outer wall of the needle main body 31, and thereby the fixing portion 82 is fixed to the needle main body 31.

The tubular portion 83 is shaped into a cylindrical tubular form. One end of the tubular portion 83 is connected to the spring seat 81, and the other end of the tubular portion 83 is connected to the fixing portion 82. In this way, the spring seat 81 is fixed to the radially outer side of the needle main body 31 at the location, which is on the valve seat 14 side of the movable core 40. That is, the specific member 80 is fixed to the needle main body 31 through the press fitting of the fixing portion 82 to the needle main body 31.

The spring 73 is, for example, a coil spring and is placed such that one end of the spring 73 contacts the spring seat 81, and the other end of the spring 73 contacts the bottom of the recess 44 of the movable core 40. The spring 73 can urge the movable core 40 toward the stationary core 50. An urging force of the spring 73 is smaller than the urging force of the spring 71. The urging force of the spring 73 is adjustable by adjusting a relative position of the spring seat 81 relative to the needle main body 31, i.e., a press fitting position of the fixing portion 82 to the needle main body 31.

The spring 71 urges the gap forming member 60 toward the valve seat 14, so that the plate portion 61 of the gap forming member 60 contacts the needle 30, and thereby the seal portion 32 of the needle 30 is urged against the valve seat 14. At this time, the spring 73 urges the movable core 40 toward the stationary core 50, so that the extending portion 62 of the gap forming member 60 contacts the movable core 40. In this state, the axial gap CL1 is formed between the contact surface 34 of the flange 33 of the needle 30 and the movable core 40, and a gap CL3 is formed between the bottom of the recess 44 of the movable core 40 and the fixing portion 82 (see FIG. 2).

The movable core 40 is reciprocatable in the axial direction between the flange 33 (the contact surface 34) of the needle 30 and the fixing portion 82. The bottom of the recess 44 of the movable core 40 is contactable with a movable core 40 side end part of the fixing portion 82. The fixing portion 82 can limit the relative movement of the movable core 40 relative to the needle 30 toward the valve seat 14 through contact of the fixing portion 82 with the movable core 40.

Furthermore, in the present embodiment, a cylindrical space S2, which is a space in a cylindrical form, is formed between the tubular portion 83 and the spring seat 81, which are located on one side of the cylindrical space S2, and the needle main body 31, which is located on the other side of the cylindrical space S2. The radial holes 314 of the needle 30 are communicated with the cylindrical space S2. Thus, the fuel in the axial hole 313 can flow toward the valve seat 14 side of the spring seat 81 through the radial holes 314 and the cylindrical space S2.

In the present embodiment, in the state where the movable core 40 is magnetically attracted toward the stationary core 50, when the energization of the coil 72 is stopped, the needle 30 and the movable core 40 are urged toward the valve seat 14 by the urging force of the spring 71 conducted through the gap forming member 60. In this way, the needle 30 moves in the valve closing direction, so that the seal portion 32 contacts the valve seat 14, thereby resulting in the valve closing state of the needle 30. Thus, the injection holes 13 are closed.

After the contacting of the seal portion 32 with the valve seat 14, the movable core 40 is moved relative to the needle 30 toward the valve seat 14 by inertia. At this time, the fixing portion 82 can limit excess movement of the movable core 40 toward the valve seat 14 through contact of the fixing portion 82 with the movable core 40. In this way, the deterioration of the response at the next valve opening time can be limited. Furthermore, the shock at the time of contacting of the movable core 40 to the fixing portion 82 can be reduced by the urging force of the spring 73, and thereby it is possible to limit the secondary valve opening, which is caused by bouncing of the needle 30 at the valve seat 14. Furthermore, the movement of the movable core 40 toward the valve seat 14 is limited by the fixing portion 82, so that it is possible to limit excessive compression of the spring 73. Thus, it is possible to limit the secondary valve opening that is caused by recollision of the movable core 40 against the flange 33 due to urging of the movable core 40 in the valve opening direction by a restoring force of the spring 73, which has been excessively compressed.

In the present embodiment, the gap forming member 60 further includes a passage 621. The passage 621 is formed in a form of a groove that is recessed from a movable core 40 side end part of the extending portion 62 toward the plate portion 61. The passage 621 connects between the inner wall and the outer wall of the extending portion 62. In this way, at the time of contacting the extending portion 62 with the movable core 40, the fuel in the annular space S1 can flow to the outside of the extending portion 62 through the passage 621. Furthermore, the fuel at the outside of the extending portion 62 can flow into the inside of the extending portion 62, i.e., the annular space S1 through the passage 621. Thus, at the time of contacting the extending portion 62 with the movable core 40, it is possible to limit a damper effect that is generated due to presence of the fuel in the annular space S1. Therefore, it is possible to limit a reduction of a kinetic energy of the movable core 40 at the time of colliding the movable core 40 against the contact surface 34 of the flange 33.

The fuel, which is supplied from the inlet portion 24, flows through the stationary core 50, the adjusting pipe 53, the hole 611 of the gap forming member 60, the axial hole 313 of the needle 30, the radial holes 314, the cylindrical space S2, the gap between the first tubular portion 21 and the needle 30, and the gap between the nozzle 10 and the needle 30, i.e., the fuel passage 100 and is guided to the injection holes 13. At the time of operating the fuel injection device 1, an area around the movable core 40 is filled with the fuel. Furthermore, at the time of operating the fuel injection device 1, the fuel flows through the through-holes 43 of the movable core 40. Therefore, the movable core 40 can smoothly reciprocate in the axial direction at the inside of the housing 20.

Next, the operation of the fuel injection device 1 of the present embodiment will be described with reference to FIGS. 2 to 5.

As shown in FIG. 2, when the coil 72 is not energized, the seal portion 32 of the needle 30 contacts the valve seat 14, while the plate portion 61 of the gap forming member 60 contacts the needle 30, and the extending portion 62 of the gap forming member 60 contacts the movable core 40. At this time, the axial gap CL1, which has the predetermined size, is formed between the contact surface 34 of the flange 33 and the movable core 40.

When the coil 72 is energized in the state shown in FIG. 2, the movable core 40 is magnetically attracted to the stationary core 50 and is thereby moved toward the stationary core 50 while the movable core 40 upwardly pushes the gap forming member 60 and is accelerated in the axial gap CL1. The movable core 40, which is accelerated in the axial gap CL1 and is thereby in the increased kinetic energy state, collides against the contact surface 34 of the flange 33 (see FIG. 3). In this way, the needle 30 is moved in the valve opening direction, so that the seal portion 32 is moved away from the valve seat 14, thereby resulting in the valve opening. Thus, the injection of the fuel from the injection holes 13 begins. At this time, the axial gap CL1 becomes zero. Furthermore, the gap CL3 is increased in comparison to the state shown in FIG. 2.

Figure 3:
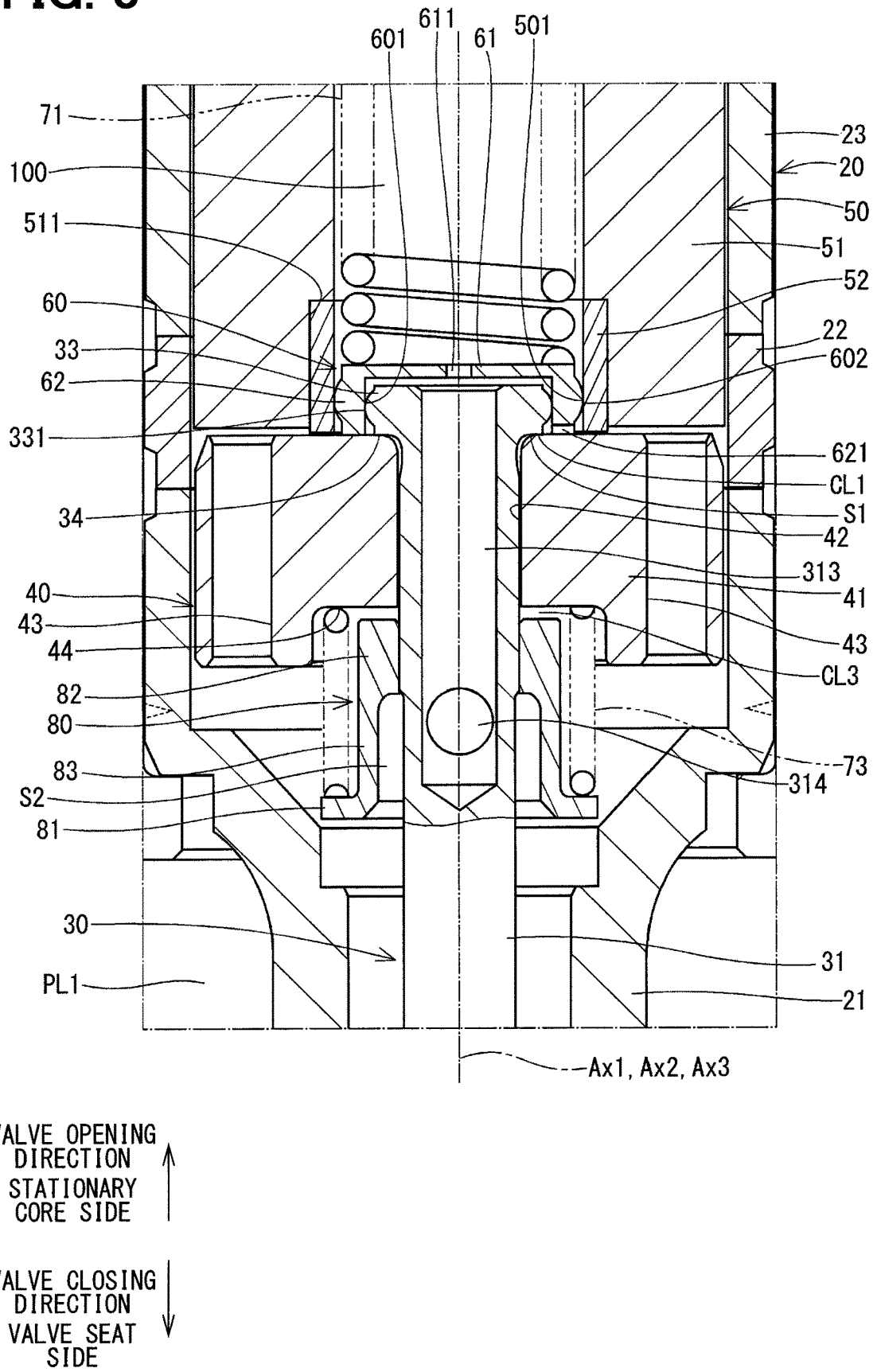
FIG. 3 is a cross-sectional view showing the movable core and its adjacent area in the fuel injection device according to the first embodiment of the present disclosure at a time of contacting a movable core to a flange during a valve opening time.

When the movable core 40 is further moved toward the stationary core 50 from the state shown in FIG. 3, the movable core 40 contacts the bush 52. Thereby, the movement of the movable core 40 in the valve opening direction is limited. At this time, the needle 30 is further moved in the valve opening direction by the inertia and contacts the plate portion 61 of the gap forming member 60 (see FIG. 4).

Figure 4:
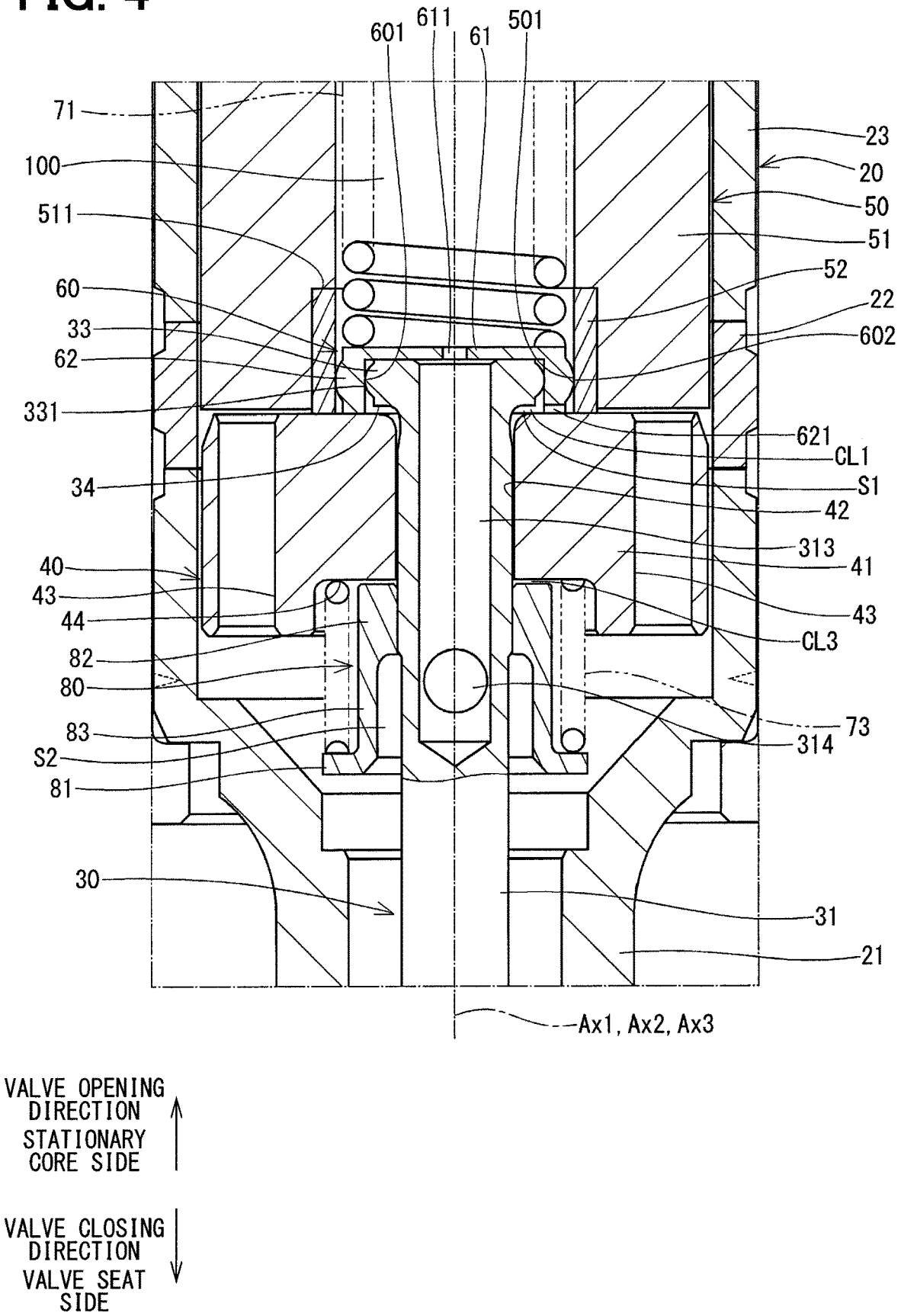
FIG. 4 is a cross-sectional view showing the movable core and its adjacent area in the fuel injection device according to the first embodiment of the present disclosure at a time of contacting the movable core to a stationary core during the valve opening time.
Figure 5:
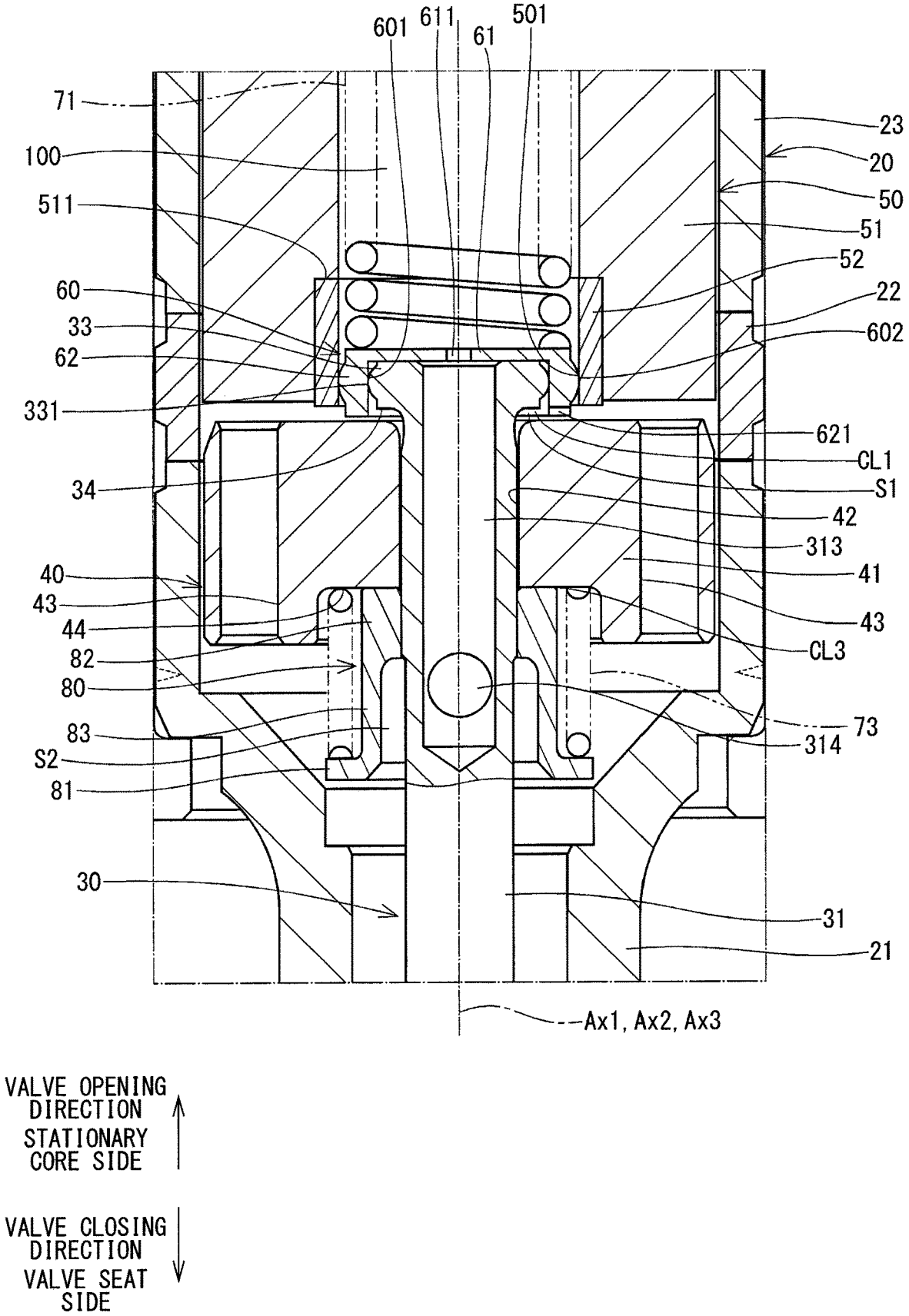
FIG. 5 is a cross-sectional view showing the movable core and its adjacent area in the fuel injection device according to the first embodiment of the present disclosure at a time of contacting the movable core to a fixing portion during a valve closing time.

In a state shown in FIG. 4, when the energization of the coil 72 is stopped, the movable core 40 and the needle 30 are moved in the valve closing direction by the urging force of the spring 71 conducted through the gap forming member 60. When the seal portion 32 of the needle 30 contacts the valve seat 14, thereby resulting in the valve closing state of the needle 30, the movable core 40 is further moved in the valve closing direction by the inertia and contacts the fixing portion 82 (see FIG. 5). Thereby, the movement of the movable core 40 in the valve closing direction is limited. At this time, the movable core 40 is spaced from the extending portion 62 of the gap forming member 60. Furthermore, the gap CL3 becomes zero. Thereafter, the movable core 40 is moved in the valve opening direction by the urging force of the spring 73 and contacts the extending portion 62 of the gap forming member 60 (see FIG. 2).

As discussed above, (1) according to the present embodiment, the nozzle 10 includes the injection holes 13, through which the fuel is injected, and the valve seat 14, which is formed around the injection holes 13 and is shaped into the ring form.

The housing 20 is shaped into the tubular form and has the one end connected to the nozzle 10, and the housing 20 has the fuel passage 100, which is formed in the inside of the housing 20 and is communicated with the injection holes 13.

The needle 30 has: the needle main body 31, which is shaped into the rod form; the seal portion 32, which is formed at the one end of the needle main body 31 such that the seal portion 32 is contactable with the valve seat 14; and the flange 33, which is formed on the radially outer side of the other end of the needle main body 31. The needle 30 is installed such that the needle 30 is reciprocatable in the fuel passage 100, and when the seal portion 32 moves away from or contacts the valve seat 14, the needle 30 opens or closes the injection holes 13.

The movable core 40 is installed such that the movable core 40 is movable relative to the needle main body 31 and has the surface, which is opposite from the valve seat 14 and is contactable with the surface (the contact surface 34) of the flange 33 located on the valve seat 14 side.

The stationary core 50 is shaped into a tubular form. Furthermore, with respect to the movable core 40 placed in the inside of the housing 20, the stationary core 50 is coaxial with the housing 20 and is located on the opposite side of the movable core 40, which is opposite from the valve seat 14.

The gap forming member 60 includes: the plate portion 61 that is placed in the inside of the stationary core 50 on the opposite side of the needle 30, which is opposite from the valve seat 14, such that the one end surface of the plate portion 61 is contactable with the needle 30; and the extending portion 62 that is formed to extend in a tubular form from the plate portion 61 toward the valve seat 14, while the opposite end part of the extending portion 62, which is opposite from the plate portion 61, is contactable with the surface of the movable core 40 located on the stationary core 50 side. The gap forming member 60 is configured to form the axial gap CL1, which is a gap defined in the axial direction between the flange 33 and the movable core 40, when the plate portion 61 and the extending portion 62 contact the needle 30 and the movable core 40, respectively.

The spring 71 is placed on the side of the gap forming member 60, which is opposite from the valve seat 14. The spring 71 is operable to urge the needle 30 and the movable core 40 toward the valve seat 14 through the gap forming member 60.

The coil 72 is operable to attract the movable core 40 toward the stationary core 50 such that the movable core 40 contacts the flange 33 and drives the needle 30 toward the opposite side, which is opposite from the valve seat 14, when the coil 72 is energized.

In the present embodiment, as discussed above, the gap forming member 60 is configured to form the axial gap CL1 between the flange 33 and the movable core 40 when the plate portion 61 and the extending portion 62 contact the needle 30 and the movable core 40, respectively. Therefore, at the time of magnetically attracting the movable core 40 toward the stationary core 50 through the energization of the coil 72, the movable core 40 can collide against the flange 33 after accelerating the movable core 40 in the axial gap CL1. In this way, the movable core 40, which has the increased kinetic energy through the acceleration of the movable core 40 in the axial gap CL1, can collide against the flange 33. Therefore, even when the fuel pressure in the fuel passage 100 is high, the valve opening of the needle 30 is possible. Thus, the high pressure fuel can be injected.

In the present embodiment, the flange 33 has a flange outer wall surface 331 at an outer wall of the flange 33 located on the radially outer side of the flange 33. The stationary core 50 has a stationary core inner wall surface 501 at an inner wall of the stationary core 50 located on the radially inner side of the stationary core 50. An inner side wall surface 601 of the gap forming member 60, which is a wall surface of the gap forming member 60 opposed to the flange outer wall surface 331, is slidable relative to the flange outer wall surface 331. Also, an outer side wall surface 602 of the gap forming member 60, which is a wall surface of the gap forming member 60 opposed to the stationary core inner wall surface 501, is slidable relative to the stationary core inner wall surface 501. Each of the flange outer wall surface 331 and the outer side wall surface 602 is curved to project in the radially outer direction of the housing 20 in a cross section of each of the flange outer wall surface 331 and the outer side wall surface 602 taken along an imaginary plane PL1, which includes an axis Ax1 of the housing 20. That is, each of the flange outer wall surface 331 and the outer side wall surface 602 is curved in the axial direction. Therefore, the flange outer wall surface 331 and the outer side wall surface 602 can make a line contact with the inner side wall surface 601 and the stationary core inner wall surface 501, respectively. Thus, even in the case where the orientation of the needle 30 is changed to tilt the axis Ax2 relative to the axis Ax1 of the housing 20 at the time of reciprocating the needle 30, it is possible to limit an increase in the slide resistance between each corresponding adjacent two of the flange 33, the gap forming member 60 and the stationary core 50, and it is also possible to limit uneven wearing of the slide surfaces of the flange 33, the gap forming member 60 and the stationary core 50. In this way, it is possible to limit the deterioration of the response of the needle 30, and it is possible to limit the unstable reciprocation of the needle 30 in the axial direction. Thus, it is possible to limit variations in the injection amount of fuel, which is injected from the fuel injection device 1. Furthermore, it is possible to limit generation of wear debris. Thus, it is possible to limit the operational failure that is caused by clamping of the wear debris between members, which make relative movement therebetween.

Furthermore, according to the present embodiment, the flange 33 and the gap forming member 60 can be constructed such that the outer peripheral edge corners of the end parts of the flange 33 and the outer peripheral edge corners of the end parts of the gap forming member 60 do not slide relative to the inner side wall surface 601 of the gap forming member 60 or the stationary core inner wall surface 501 of the stationary core 50, respectively. Therefore, even in the case where the orientation of the needle 30 is changed to tilt the axis Ax2 of the needle 30 at the time of reciprocating the needle 30 and the gap forming member 60 in the axial direction, it is possible to limit catching of the edge corners of the flange 33 by the inner side wall surface 601 of the gap forming member 60 and catching of the edge corner of the gap forming member 60 by the stationary core inner wall surface 501 of the stationary core 50 (the bush 52). In this way, it is possible to limit the operational failure of the needle 30.

Furthermore, (2) in the present embodiment, each of the flange outer wall surface 331 and the outer side wall surface 602 is curved to project in the radially outer direction of the housing 20 in the cross section of each of the flange outer wall surface 331 and the outer side wall surface 602 taken along the imaginary plane PL1. The flange outer wall surface 331 is formed to extend along a portion of a first imaginary circle C1 in the imaginary plane PL1. The outer side wall surface 602 is formed to extend along the portion of the second imaginary circle C2 in the imaginary plane PL1. The center O1 of the first imaginary circle C1 and the center O2 of the second imaginary circle C2 are located along the imaginary straight line Ln1, which is perpendicular to the axis Ax1 of the housing 20, when the plate portion 61 is in contact with the needle 30.

Furthermore, (5) in the present embodiment, the flange outer wall surface 331 and the outer side wall surface 602 are formed as follows. That is, each of the flange outer wall surface 331 and the outer side wall surface 602 is curved to project in the radially outer direction of the housing 20 in the cross section of each of the flange outer wall surface 331 and the outer side wall surface 602 taken along the imaginary plane PL1. Also, the maximum outer diameter part Pc1 of the flange outer wall surface 331, which has the maximum outer diameter in the flange outer wall surface 331, and the maximum outer diameter part Pc2 of the outer side wall surface 602, which has the maximum outer diameter in the outer side wall surface 602, are located along the imaginary straight line Ln1, which is perpendicular to the axis Ax1 of the housing 20, when the plate portion 61 is in contact with the needle 30.

Therefore, a slide part (Pc1), at which the flange 33 and the gap forming member 60 slide relative to each other, and a slide part (Pc2), at which the gap forming member 60 and the stationary core 50 (the bush 52) slide relative to each other, can be placed generally at the same location in the axial direction of the axis Ax1. Therefore, the axial reciprocation of the needle 30 can be more stably guided by the stationary core 50 (the bush 52) and the gap forming member 60.

Furthermore, (12) in the present embodiment, each of the flange outer wall surface 331 and the outer side wall surface 602 is formed to extend along the portion of the corresponding imaginary circle (the first imaginary circle C1, the second imaginary circle C2) in the cross section taken in the imaginary plane PL1. Therefore, the flange outer wall surface 331 and the outer side wall surface 602 can be easily designed and formed.

Second Embodiment

Figure 6:
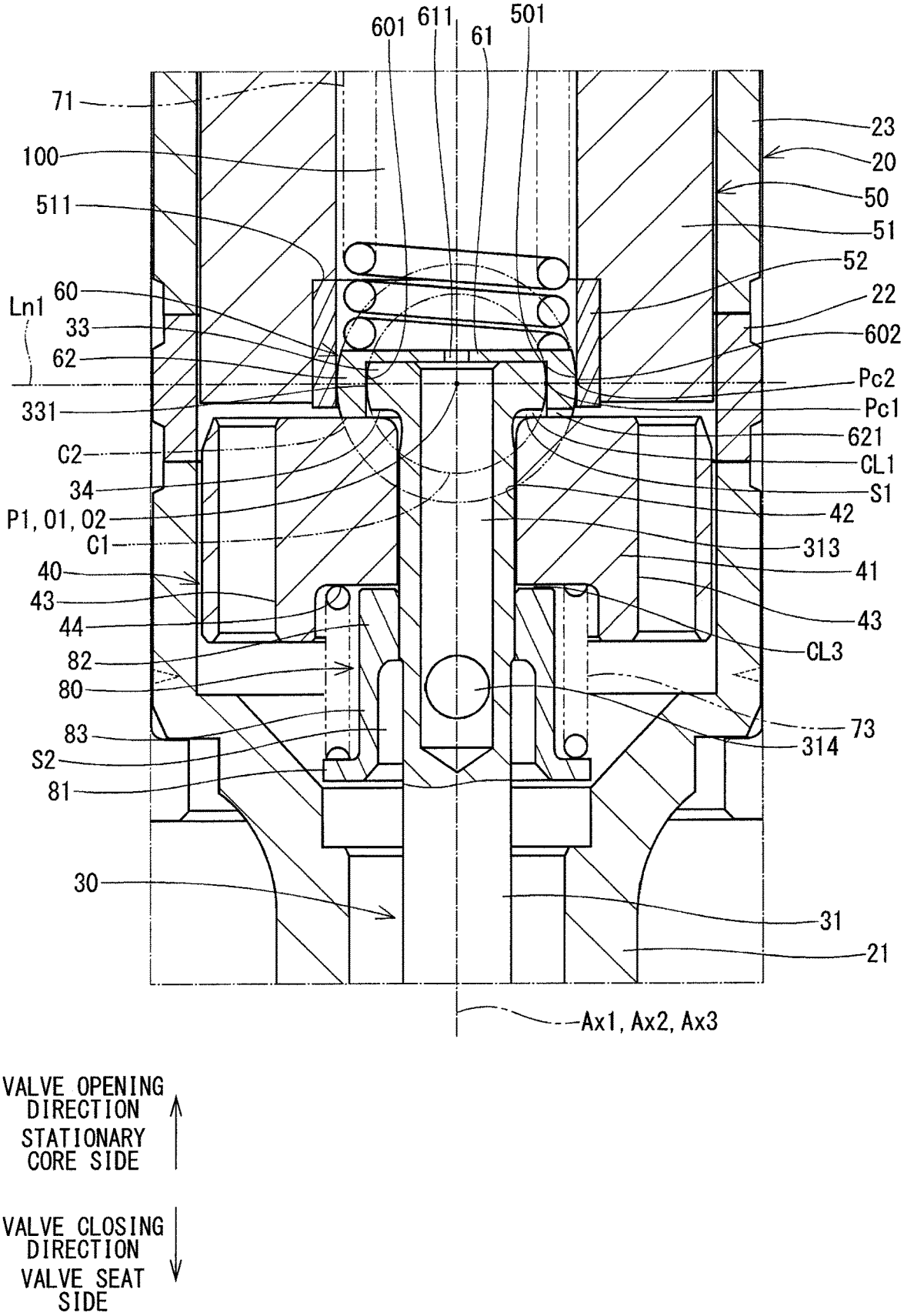
FIG. 6 is a cross-sectional view showing a movable core and its adjacent area in a fuel injection device according to a second embodiment of the present disclosure.

FIG. 6 shows a portion of the fuel injection device according to a second embodiment of the present disclosure. The second embodiment differs from the first embodiment with respect to the shapes of the flange 33 and the gap forming member 60.

In the second embodiment, the flange outer wall surface 331 is formed along an entire axial extent of the outer wall of the flange 33 located on the radially outer side. Furthermore, the outer side wall surface 602 is formed along an entire axial extent of the outer wall of the gap forming member 60 located on the radially outer side such that the outer side wall surface 602 is opposed to the stationary core inner wall surface 501.

The center O1 of the first imaginary circle C1 and the center O2 of the second imaginary circle C2 are located along the imaginary straight line Ln1, which is perpendicular to the axis Ax1 of the housing 20, when the plate portion 61 is in contact with the needle 30. Furthermore, the center O1 of the first imaginary circle C1 and the center O2 of the second imaginary circle C2 are located along the axis Ax1 of the housing 20 (see FIG. 6). That is, in the present embodiment, the center O1 of the first imaginary circle C1, along which the flange outer wall surface 331 extends, and the center O2 of the second imaginary circle C2, along which the outer side wall surface 602 extends, coincide with each other at an intersection P1 where the axis Ax1 of the housing 20 and the imaginary straight line Ln1 intersect with each other. Thus, the flange outer wall surface 331 is formed to extend along a portion of a corresponding imaginary sphere that is centered at O1. Also, the outer side wall surface 602 is formed to extend along a portion of a corresponding imaginary sphere that is centered at O2.

In the present embodiment, the gap forming member 60 may be formed as follows. That is, a spherical body, which is centered at O2, is first formed by, for example, polishing. Thereafter, this spherical body is formed into a bottomed tubular form having the plate portion 61 and the extending portion 62 by, for example, cutting. In this case, the outer side wall surface 602 can be highly accurately formed such that the outer side wall surface 602 extends along the second imaginary circle C2.

In the second embodiment, the rest of the structure, which is other than the above point, is the same as that of the first embodiment.

As discussed above, (2) in the second embodiment, when the plate portion 61 contacts the needle 30, the center O1 of the first imaginary circle C1 and the center O2 of the second imaginary circle C2 are located along the imaginary straight line Ln1 that is perpendicular to the axis Ax1 of the housing 20. Furthermore, (3), (4) the center O1 of the first imaginary circle C1 and the center O2 of the second imaginary circle C2 are located along the axis Ax1 of the housing 20. That is, in the present embodiment, the center O1 of the first imaginary circle C1, along which the flange outer wall surface 331 extends, and the center O2 of the second imaginary circle C2, along which the outer side wall surface 602 extends, coincide with each other at the intersection P1 where the axis Ax1 of the housing 20 and the imaginary straight line Ln1 intersect with each other. Thus, the flange outer wall surface 331 is formed to extend along the portion of the corresponding imaginary sphere that is centered at O1. Also, the outer side wall surface 602 is formed to extend along the portion of the corresponding imaginary sphere that is centered at O2. Therefore, a distance (a radius of the first imaginary circle C1) from the center O1 to the flange outer wall surface 331 is constant. Furthermore, a distance (a radius of the second imaginary circle C2) from the center O2 to the outer side wall surface 602 is constant. Therefore, even in the case where, for example, the orientation of the needle 30 is changed to tilt the axis Ax2, or the orientation of the gap forming member 60 is changed to tilt the axis of the tubular portion 83 at the time of reciprocating the needle 30 and the gap forming member 60 in the axial direction, it is possible to limit the uneven wearing of the slide surfaces by limiting an increase in the slide resistance between the flange outer wall surface 331 and the inner side wall surface 601 and an increase in the slide resistance between the outer side wall surface 602 and the stationary core inner wall surface 501.

Third Embodiment

Figure 7:
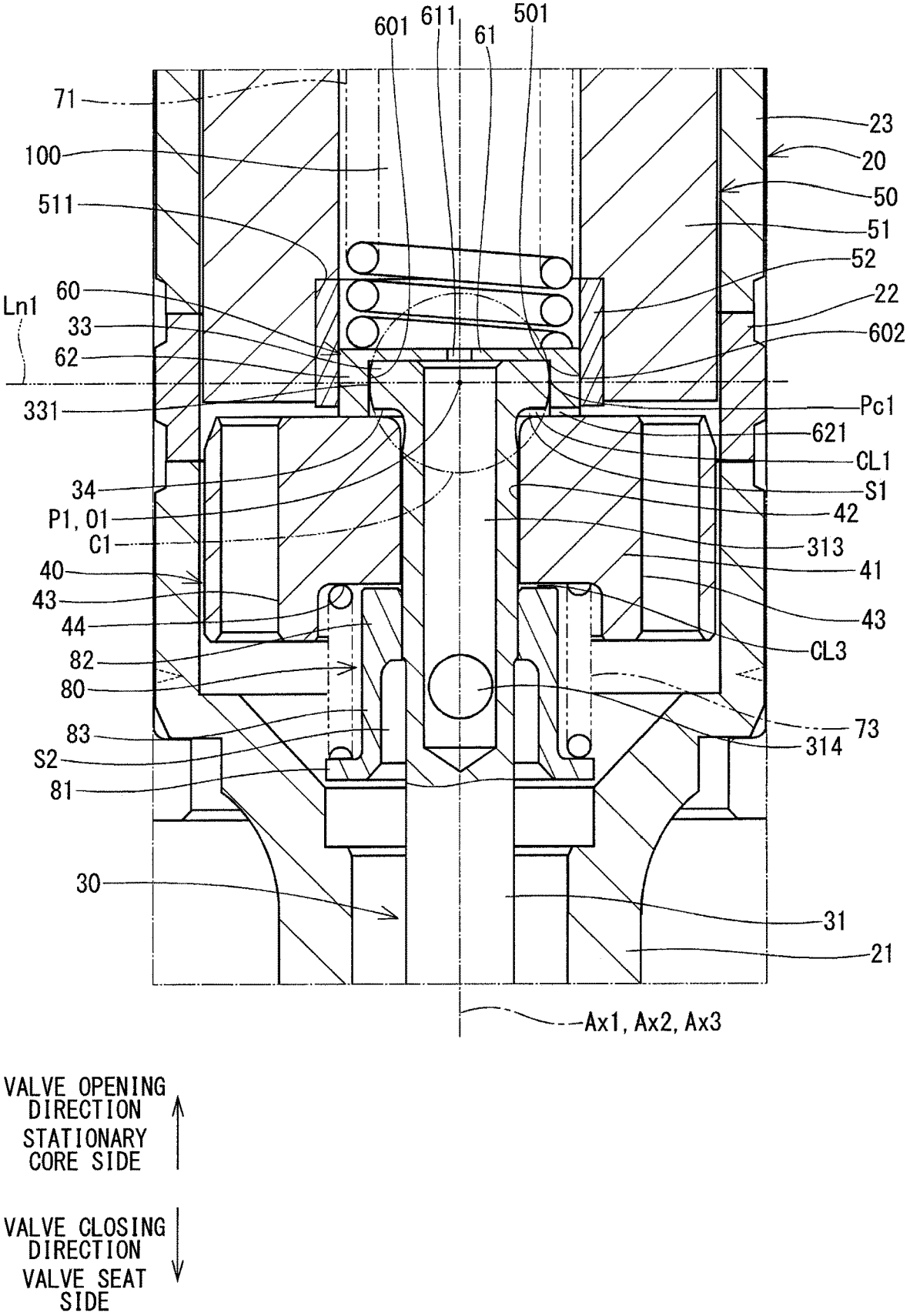
FIG. 7 is a cross-sectional view showing a movable core and its adjacent area in a fuel injection device according to a third embodiment of the present disclosure.

FIG. 7 shows a portion of the fuel injection device according to a third embodiment of the present disclosure. The third embodiment differs from the second embodiment with respect to the shape of the gap forming member 60.

In the third embodiment, the outer side wall surface 602 of the gap forming member 60 is formed into a cylindrical form. Furthermore, the outer diameter of the outer side wall surface 602 is set to be equal to the inner diameter of the stationary core inner wall surface 501 of the stationary core 50 or is set to be slightly smaller than the inner diameter of the stationary core inner wall surface 501. Therefore, the outer side wall surface 602 is slidable relative to the stationary core inner wall surface 501.

In the third embodiment, the rest of the structure, which is other than the above-described point, is the same as that of the second embodiment.

As discussed above, (1) in the present embodiment, the flange outer wall surface 331, which is the one of the flange outer wall surface 331 or the outer side wall surface 602, is curved to project in the radially outer direction of the housing 20 in the cross section of the flange outer wall surface 331 taken along the imaginary plane PL1, which includes the axis Ax1 of the housing 20. That is, the flange outer wall surface 331 is curved in the axial direction. Therefore, the flange outer wall surface 331 can make a line contact with the inner side wall surface 601 that is shaped into the cylindrical surface. Thus, even in the case where the orientation of the needle 30 is changed to tilt the axis Ax2 relative to the axis Ax1 of the housing 20 at the time of reciprocating the needle 30, it is possible to limit an increase in the slide resistance between the flange 33 and the gap forming member 60, and it is also possible to limit the uneven wearing of the slide surfaces. In this way, it is possible to limit the deterioration of the response of the needle 30, and it is possible to limit the unstable reciprocation of the needle 30 in the axial direction. Thus, it is possible to limit variations in the injection amount of fuel, which is injected from the fuel injection device.

Furthermore, (3) in the present embodiment, the center O1 of the first imaginary circle C1 is located along the axis Ax1 of the housing 20. Thus, the flange outer wall surface 331 is formed to extend along the portion of the corresponding imaginary sphere that is centered at O1. Therefore, the distance (the radius of the first imaginary circle C1) from the center O1 to the flange outer wall surface 331 is constant. Thus, even in the case where, for example, the orientation of the needle 30 is changed to tilt the axis Ax2 at the time of reciprocating the needle 30 and the gap forming member 60 in the axial direction, it is possible to limit an increase in the slide resistance between the flange outer wall surface 331 and the inner side wall surface 601, and thereby it is possible to limit the uneven wearing of the slide surfaces.

Fourth Embodiment

Figure 8:
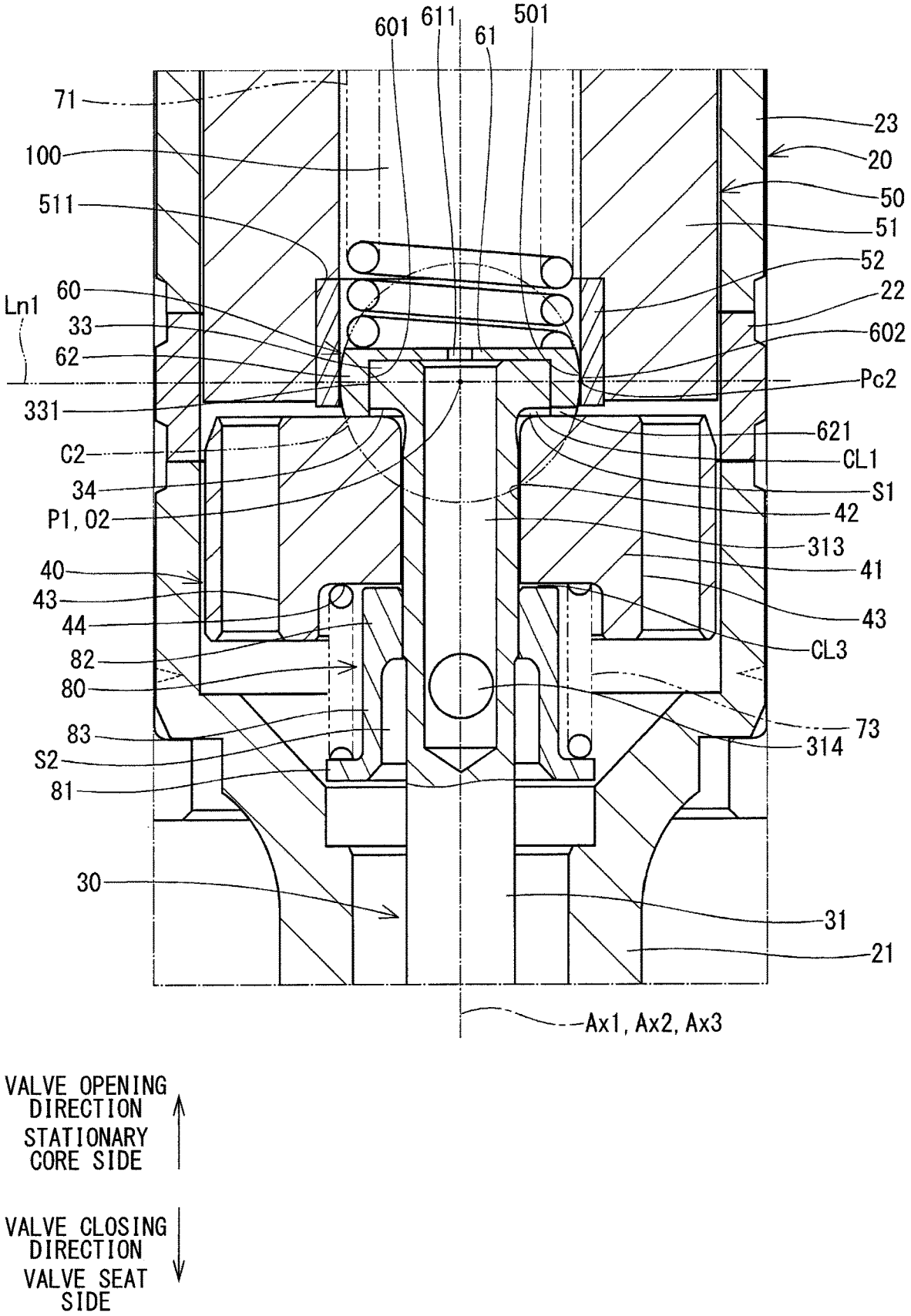
FIG. 8 is a cross-sectional view showing a movable core and its adjacent area in a fuel injection device according to a fourth embodiment of the present disclosure.

FIG. 8 shows a portion of the fuel injection device according to a fourth embodiment of the present disclosure. The fourth embodiment differs from the second embodiment with respect to the shape of the flange 33.

In the fourth embodiment, the flange outer wall surface 331 of the flange 33 is formed into a cylindrical form. Furthermore, the outer diameter of the flange outer wall surface 331 is set to be equal to the inner diameter of the inner side wall surface 601 of the gap forming member 60 or is set to be slightly smaller than the inner diameter of the inner side wall surface 601. Therefore, the flange outer wall surface 331 is slidable relative to the inner side wall surface 601.

In the fourth embodiment, the rest of the structure, which is other than the above-described point, is the same as that of the second embodiment.

As discussed above, (1) in the present embodiment, the outer side wall surface 602, which is the one of the flange outer wall surface 331 or the outer side wall surface 602, is curved to project in the radially outer direction of the housing 20 in the cross section of the outer side wall surface 602 taken along the imaginary plane PL1, which includes the axis Ax1 of the housing 20. That is, the outer side wall surface 602 is curved in the axial direction. Therefore, the outer side wall surface 602 can make a line contact with the stationary core inner wall surface 501, which is shaped in the form of the cylindrical surface. Thus, even in the case where the orientation of the needle 30 is changed to tilt the axis Ax2 relative to the axis Ax1 of the housing 20 at the time of reciprocating the needle 30, it is possible to limit an increase in the slide resistance between the gap forming member 60 and the stationary core 50, and it is possible to limit the uneven wearing of the slide surfaces. In this way, it is possible to limit the deterioration of the response of the needle 30, and it is possible to limit the unstable reciprocation of the needle 30 in the axial direction. Thus, it is possible to limit variations in the injection amount of fuel, which is injected from the fuel injection device.

Furthermore, (4) in the present embodiment, the center O2 of the second imaginary circle C2 is located along the axis Ax1 of the housing 20. Thus, the outer side wall surface 602 is formed to extend along the portion of the corresponding imaginary sphere that is centered at O2. Therefore, the distance (the radius of the second imaginary circle C2) from the center O2 to the outer side wall surface 602 is constant. Therefore, even in the case where, for example, the orientation of the needle 30 is changed to tilt the axis Ax2 at the time of reciprocating the needle 30 and the gap forming member 60 in the axial direction, and thereby the orientation of the gap forming member 60 is changed to tilt the axis of the tubular portion 83, it is possible to limit the uneven wearing of the slide surfaces by limiting an increase in the slide resistance between the outer side wall surface 602 and the stationary core inner wall surface 501.

Fifth Embodiment

Figure 9:
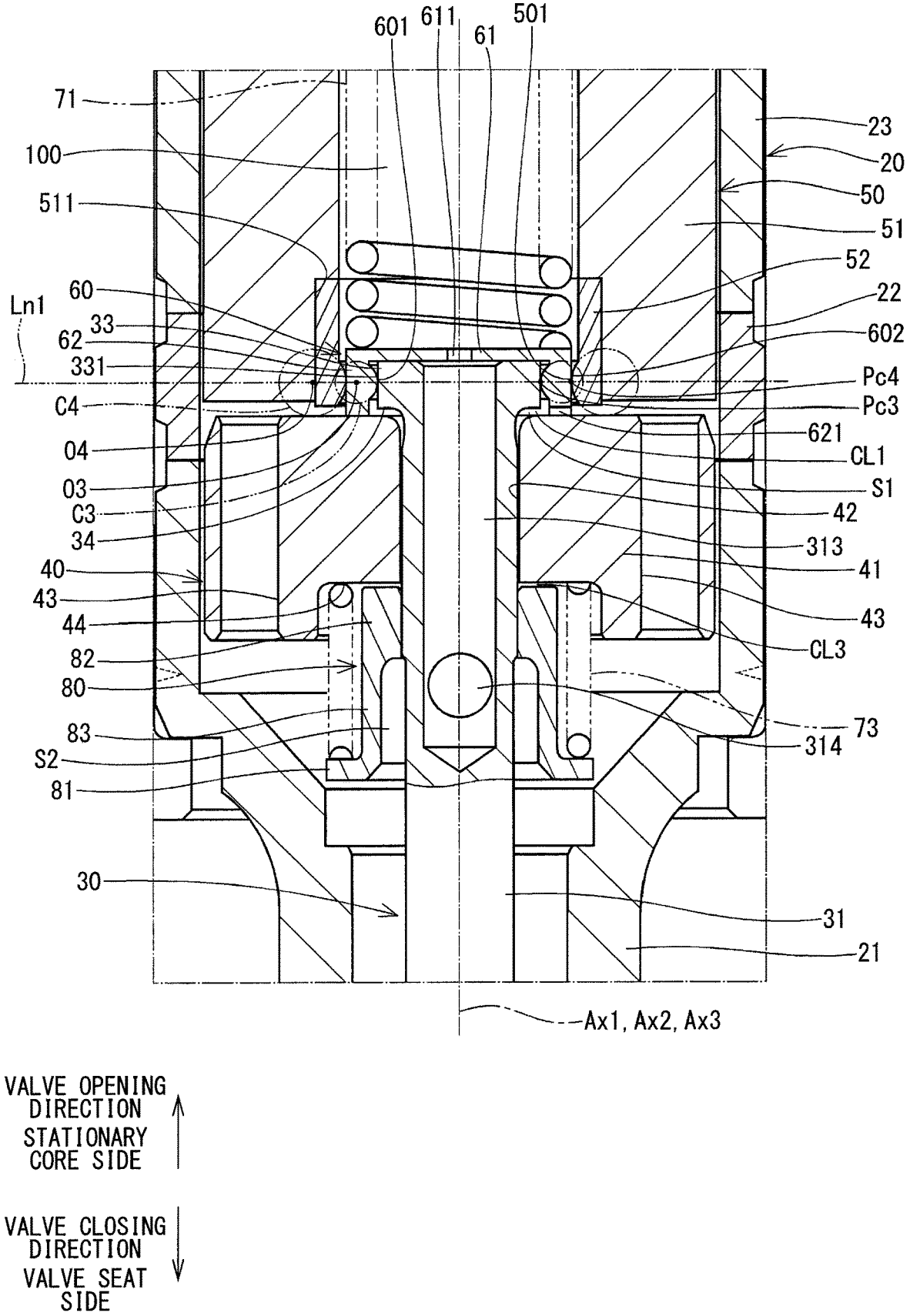
FIG. 9 is a cross-sectional view showing a movable core and its adjacent area in a fuel injection device according to a fifth embodiment of the present disclosure.

FIG. 9 shows a portion of the fuel injection device according to a fifth embodiment of the present disclosure. In the fifth embodiment, the shapes of the flange 33, the gap forming member 60 and the stationary core 50 are different from those of the first embodiment.

In the fifth embodiment, the flange outer wall surface 331 of the flange 33 and the outer side wall surface 602 of the gap forming member 60 are respectively shaped in a form of a cylindrical surface. Each of the inner side wall surface 601 of the gap forming member 60 and the stationary core inner wall surface 501 of the stationary core 50 are curved to project in a radially inner direction of the housing 20 in a cross section of each of the inner side wall surface 601 of the gap forming member 60 and the stationary core inner wall surface 501 of the stationary core 50 taken along the imaginary plane PL1, which includes the axis Ax1 of the housing 20 (see FIG. 9). That is, the inner side wall surface 601 is shaped in a form of a curved surface that is curved in the axial direction to project relative to the flange outer wall surface 331. Furthermore, the stationary core inner wall surface 501 is shaped in a form of a curved surface that is curved in the axial direction to project relative to the outer side wall surface 602.

Furthermore, in the present embodiment, the inner side wall surface 601 is formed to extend along a portion of a third imaginary circle C3 in the imaginary plane PL1. The stationary core inner wall surface 501 is formed to extend along a portion of a fourth imaginary circle C4 in the imaginary plane PL1. A center O3 of the third imaginary circle C3 and a center O4 of the fourth imaginary circle C4 are located along the imaginary straight line Ln1, which is perpendicular to the axis Ax1 of the housing 20, when the plate portion 61 is in contact with the needle 30 (see FIG. 9).

In the present embodiment, a diameter of the third imaginary circle C3 is smaller than a diameter of the fourth imaginary circle C4. The center O3 of the third imaginary circle C3 and the center O4 of the fourth imaginary circle C4 are located on the radially outer side of the axis Ax1 of the housing 20. More specifically, the center O3 is located at the tubular portion 83, and the center O4 is located at a location that is adjacent to the bush 52 of the stationary core main body 51 (see FIG. 9).

In the fifth embodiment, the rest of the structure, which is other than the above-described point, is the same as that of the first embodiment.

As discussed above, (6) in the present embodiment, each of the inner side wall surface 601 and the stationary core inner wall surface 501 is curved to project in the radially inner direction of the housing 20 in the cross section of each of the inner side wall surface 601 and the stationary core inner wall surface 501 taken along the imaginary plane PL1, which includes the axis Ax1 of the housing 20. That is, each of the inner side wall surface 601 and the stationary core inner wall surface 501 is curved in the axial direction. Therefore, the inner side wall surface 601 and the stationary core inner wall surface 501 can make a line contact with the flange outer wall surface 331 and the outer side wall surface 602, respectively. Thus, even in the case where the orientation of the needle 30 is changed to tilt the axis Ax2 relative to the axis Ax1 of the housing 20 at the time of reciprocating the needle 30, it is possible to limit an increase in the slide resistance between each corresponding adjacent two of the flange 33, the gap forming member 60 and the stationary core 50, and it is also possible to limit uneven wearing of the slide surfaces of the flange 33, the gap forming member 60 and the stationary core 50. In this way, it is possible to limit the deterioration of the response of the needle 30, and it is possible to limit the unstable reciprocation of the needle 30 in the axial direction. Thus, it is possible to limit variations in the injection amount of fuel, which is injected from the fuel injection device. Furthermore, it is possible to limit generation of wear debris. Thus, it is possible to limit the operational failure that is caused by clamping of the wear debris between members, which make relative movement therebetween.

Furthermore, according to the present embodiment, the flange 33 and the gap forming member 60 can be constructed such that the outer peripheral edge corners of the end parts of the flange 33 and the outer peripheral edge corners of the end parts of the gap forming member 60 do not slide relative to the inner side wall surface 601 of the gap forming member 60 or the stationary core inner wall surface 501 of the stationary core 50, respectively. In this way, it is possible to limit the operational failure of the needle 30.

Furthermore, (7) in the present embodiment, each of the inner side wall surface 601 and the stationary core inner wall surface 501 is curved to project in the radially inner direction of the housing 20 in the cross section of each of the inner side wall surface 601 and the stationary core inner wall surface 501 taken along the imaginary plane PL1. The inner side wall surface 601 is formed to extend along a portion of the third imaginary circle C3 in the imaginary plane PL1. The stationary core inner wall surface 501 is formed to extend along a portion of the fourth imaginary circle C4 in the imaginary plane PL1. The center O3 of the third imaginary circle C3 and the center O4 of the fourth imaginary circle C4 are located along the imaginary straight line Ln1, which is perpendicular to the axis Ax1 of the housing 20, when the plate portion 61 is in contact with the needle 30.

Thus, a slide part (Pc3), at which the flange 33 and the gap forming member 60 slide relative to each other, and a slide part (Pc4), at which the gap forming member 60 and the stationary core 50 (the bush 52) slide relative to each other, can be placed generally at the same location in the axial direction of the axis Ax1. Therefore, the axial reciprocation of the needle 30 can be more stably guided by the stationary core 50 (the bush 52) and the gap forming member 60.

Furthermore, (12) in the present embodiment, each of the inner side wall surface 601 and the stationary core inner wall surface 501 is formed to extend along the portion of the corresponding imaginary circle (the third imaginary circle C3, the fourth imaginary circle C4) in the cross section taken in the imaginary plane PL1. Therefore, the inner side wall surface 601 and the stationary core inner wall surface 501 can be easily designed and formed.

Sixth Embodiment

Figure 10:
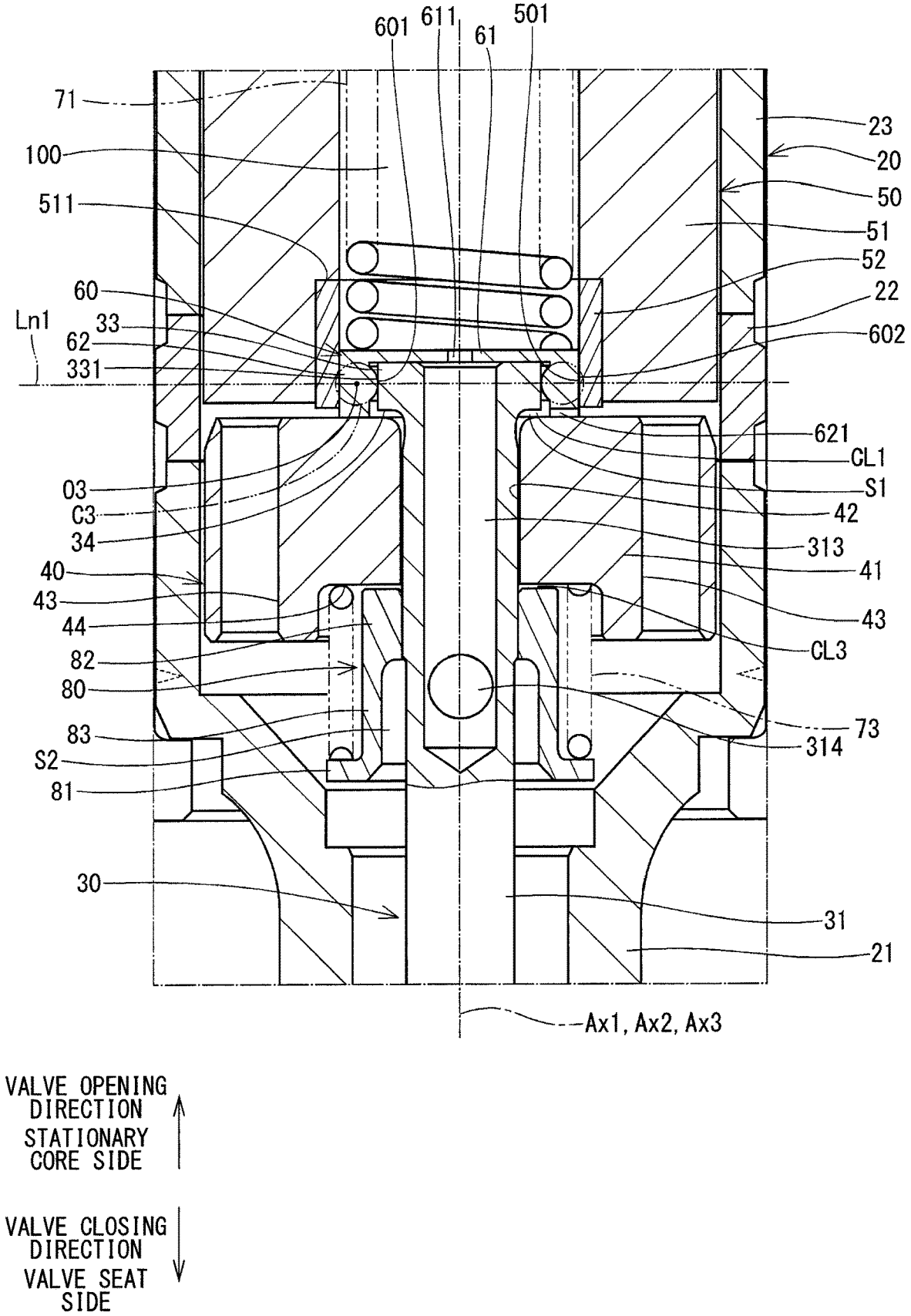
FIG. 10 is a cross-sectional view showing a movable core and its adjacent area in a fuel injection device according to a sixth embodiment of the present disclosure.

FIG. 10 shows a portion of the fuel injection device according to a sixth embodiment of the present disclosure. The sixth embodiment differs from the fifth embodiment with respect to the shape of the stationary core 50.

In the sixth embodiment, the stationary core inner wall surface 501 of the stationary core 50 is formed into a cylindrical form. Furthermore, the outer diameter of the outer side wall surface 602 is set to be equal to the inner diameter of the stationary core inner wall surface 501 or is set to be slightly smaller than the inner diameter of the stationary core inner wall surface 501. Therefore, the outer side wall surface 602 is slidable relative to the stationary core inner wall surface 501.

In the sixth embodiment, the rest of the structure, which is other than the above-described point, is the same as that of the fifth embodiment.

As discussed above, (6) in the present embodiment, the inner side wall surface 601, which is the one of the inner side wall surface 601 or the stationary core inner wall surface 501, is curved to project in the radially inner direction of the housing 20 in the cross section of the inner side wall surface 601 taken along the imaginary plane PL1, which includes the axis Ax1 of the housing 20. That is, the inner side wall surface 601 is curved in the axial direction. Therefore, the inner side wall surface 601 can make a line contact with the flange outer wall surface 331, which is shaped in the form of the cylindrical surface. Thus, even in the case where the orientation of the needle 30 is changed to tilt the axis Ax2 relative to the axis Ax1 of the housing 20 at the time of reciprocating the needle 30, it is possible to limit an increase in the slide resistance between the flange 33 and the gap forming member 60, and it is also possible to limit the uneven wearing of the slide surfaces. Thus, it is possible to limit variations in the injection amount of fuel, which is injected from the fuel injection device.

Seventh Embodiment

Figure 11:
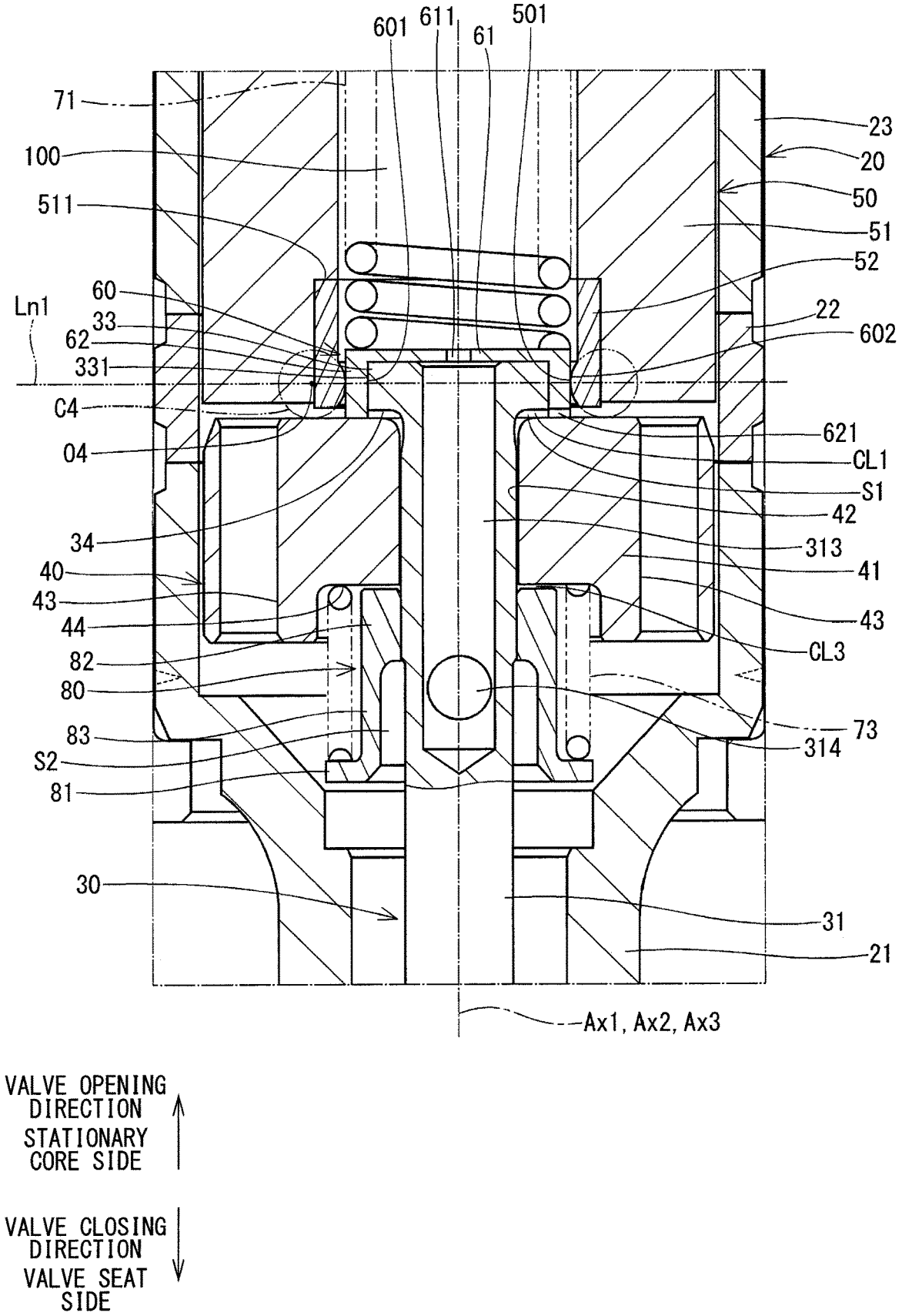
FIG. 11 is a cross-sectional view showing a movable core and its adjacent area in a fuel injection device according to a seventh embodiment of the present disclosure.

FIG. 11 shows a portion of the fuel injection device according to a seventh embodiment of the present disclosure. The seventh embodiment differs from the fifth embodiment with respect to the shape of the gap forming member 60.

In the seventh embodiment, the inner side wall surface 601 of the gap forming member 60 is formed into a cylindrical form. An outer diameter of the flange outer wall surface 331 is set to be equal to the inner diameter of the inner side wall surface 601 or is set to be slightly smaller than the inner diameter of the inner side wall surface 601. Therefore, the flange outer wall surface 331 is slidable relative to the inner side wall surface 601.

In the seventh embodiment, the rest of the structure, which is other than the above-described point, is the same as that of the fifth embodiment.

As discussed above, (6) in the present embodiment, the stationary core inner wall surface 501, which is the one of the inner side wall surface 601 or the stationary core inner wall surface 501, is curved to project in the radially inner direction of the housing 20 in the cross section of the stationary core inner wall surface 501 taken along the imaginary plane PL1, which includes the axis Ax1 of the housing 20. That is, the stationary core inner wall surface 501 is curved in the axial direction. Therefore, the stationary core inner wall surface 501 can make a line contact with the outer side wall surface 602 that is shaped into the cylindrical surface. Thus, even in the case where the orientation of the needle 30 is changed to tilt the axis Ax2 relative to the axis Ax1 of the housing 20 at the time of reciprocating the needle 30, it is possible to limit an increase in the slide resistance between the gap forming member 60 and the stationary core 50, and it is possible to limit the uneven wearing of the slide surfaces. Thus, it is possible to limit variations in the injection amount of fuel, which is injected from the fuel injection device.

Eighth Embodiment

Figure 12:
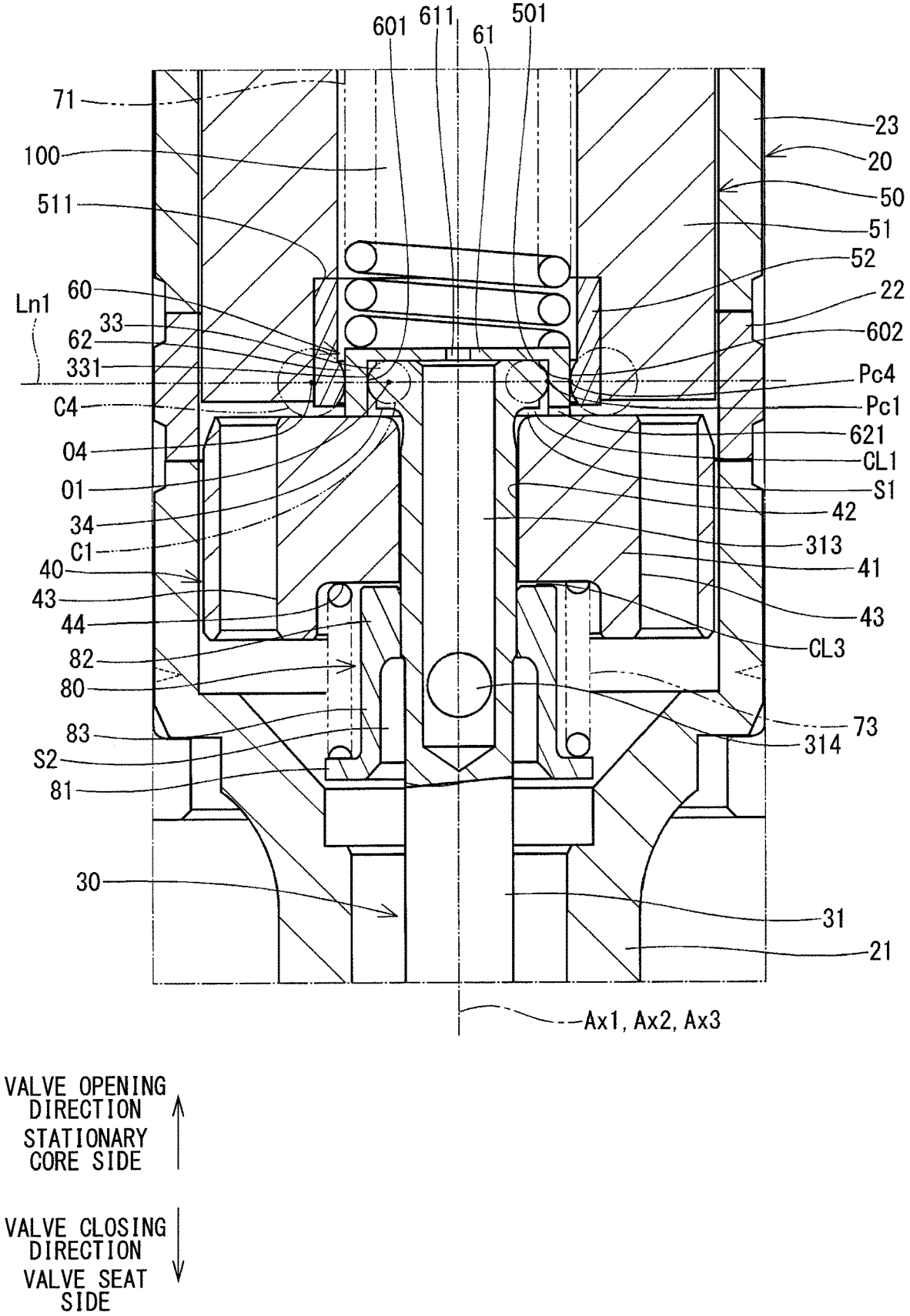
FIG. 12 is a cross-sectional view showing a movable core and its adjacent area in a fuel injection device according to an eighth embodiment of the present disclosure.

FIG. 12 shows a portion of the fuel injection device according to an eighth embodiment of the present disclosure. The eighth embodiment differs from the first embodiment with respect to the shape of the gap forming member 60 and the shape of the stationary core 50.

In the eighth embodiment, the outer side wall surface 602 of the gap forming member 60 is formed into a cylindrical form. The stationary core inner wall surface 501 of the stationary core 50 is curved to project in the radially inner direction of the housing 20 in a cross section of the stationary core inner wall surface 501 taken along the imaginary plane PL1, which includes the axis Ax1 of the housing 20 (see FIG. 12). That is, the stationary core inner wall surface 501 is shaped in a form of a curved surface that is curved in the axial direction to project relative to the outer side wall surface 602.

Furthermore, in the present embodiment, the stationary core inner wall surface 501 is formed to extend along a portion of the fourth imaginary circle C4 in the imaginary plane PL1, like in the fifth embodiment. The center O1 of the first imaginary circle C1 and the center O4 of the fourth imaginary circle C4 are located along the imaginary straight line Ln1, which is perpendicular to the axis Ax1 of the housing 20, when the plate portion 61 is in contact with the needle 30 (see FIG. 12).

In the eighth embodiment, the rest of the structure, which is other than the above-described point, is the same as that of the first embodiment.

As discussed above, (8) in the present embodiment, the flange outer wall surface 331 is curved to project in the radially outer direction of the housing 20 in the cross section of the flange outer wall surface 331 taken along the imaginary plane PL1, which includes the axis Ax1 of the housing 20. The stationary core inner wall surface 501 is curved to project in the radially inner direction of the housing 20 in the cross section of the stationary core inner wall surface 501 taken along the imaginary plane PL1. That is, each of the flange outer wall surface 331 and the stationary core inner wall surface 501 is curved in the axial direction. Therefore, the flange outer wall surface 331 and the stationary core inner wall surface 501 can make a line contact with the inner side wall surface 601 or the outer side wall surface 602, respectively, which are shaped in the form of the cylindrical surface. Thus, even in the case where the orientation of the needle 30 is changed to tilt the axis Ax2 relative to the axis Ax1 of the housing 20 at the time of reciprocating the needle 30, it is possible to limit an increase in the slide resistance between each corresponding adjacent two of the flange 33, the gap forming member 60 and the stationary core 50, and it is also possible to limit uneven wearing of the slide surfaces of the flange 33, the gap forming member 60 and the stationary core 50. In this way, it is possible to limit the deterioration of the response of the needle 30, and it is possible to limit the unstable reciprocation of the needle 30 in the axial direction. Thus, it is possible to limit variations in the injection amount of fuel, which is injected from the fuel injection device. Furthermore, it is possible to limit generation of wear debris. Thus, it is possible to limit the operational failure that is caused by clamping of the wear debris between members, which make relative movement therebetween.

Furthermore, according to the present embodiment, the flange 33 and the gap forming member 60 can be constructed such that the outer peripheral edge corners of the end parts of the flange 33 and the outer peripheral edge corners of the end parts of the gap forming member 60 do not slide relative to the inner side wall surface 601 of the gap forming member 60 or the stationary core inner wall surface 501 of the stationary core 50, respectively. Therefore, even in the case where the orientation of the needle 30 is changed to tilt the axis Ax2 of the needle 30 at the time of reciprocating the needle 30 and the gap forming member 60 in the axial direction, it is possible to limit the catching of the edge corners of the flange 33 by the inner side wall surface 601 of the gap forming member 60 and the catching of the edge corner of the gap forming member 60 by the stationary core inner wall surface 501 of the stationary core 50. In this way, it is possible to limit the operational failure of the needle 30.

Furthermore, (9) in the present embodiment, the flange outer wall surface 331 is formed to extend along a portion of a first imaginary circle C1 in the imaginary plane PL1. The stationary core inner wall surface 501 is formed to extend along a portion of the fourth imaginary circle C4 in the imaginary plane PL1. The center O1 of the first imaginary circle C1 and the center O4 of the fourth imaginary circle C4 are located along the imaginary straight line Ln1, which is perpendicular to the axis Ax1 of the housing 20, when the plate portion 61 is in contact with the needle 30.

Thus, the slide part (Pc1), at which the flange 33 and the gap forming member 60 slide relative to each other, and the slide part (Pc4), at which the gap forming member 60 and the stationary core 50 (the bush 52) slide relative to each other, can be placed generally at the same location in the axial direction of the axis Ax1. Therefore, the axial reciprocation of the needle 30 can be more stably guided by the stationary core 50 (the bush 52) and the gap forming member 60.

Ninth Embodiment

Figure 13:
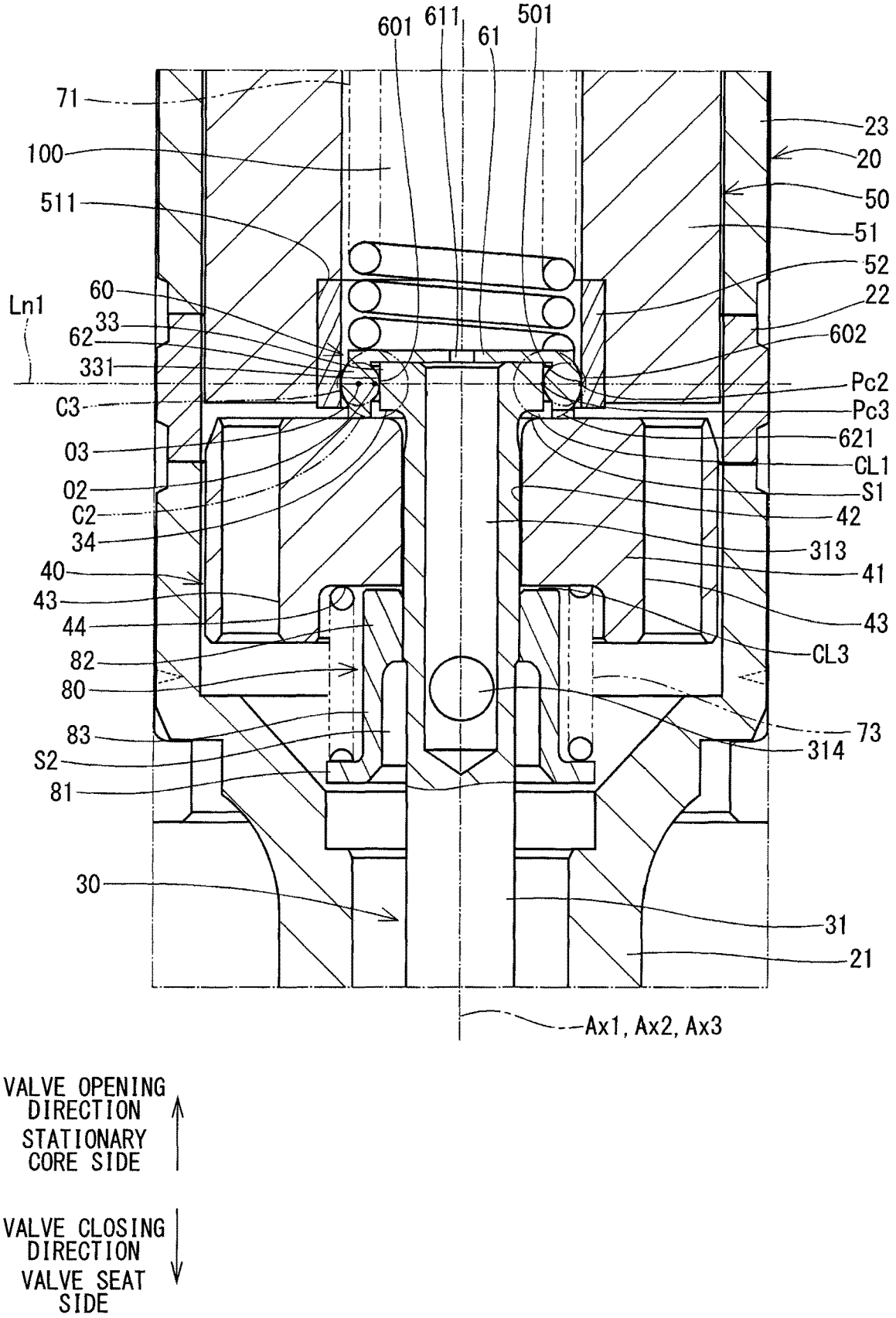
FIG. 13 is a cross-sectional view showing a movable core and its adjacent area in a fuel injection device according to a ninth embodiment of the present disclosure.

FIG. 13 shows a portion of the fuel injection device according to a ninth embodiment of the present disclosure. The ninth embodiment differs from the first embodiment with respect to the shapes of the flange 33 and the gap forming member 60.

In the ninth embodiment, the flange outer wall surface 331 of the flange 33 is formed into a cylindrical form. The inner side wall surface 601 of the gap forming member 60 is curved to project in the radially inner direction of the housing 20 in a cross section of the inner side wall surface 601 taken along the imaginary plane PL1, which includes the axis Ax1 of the housing 20 (see FIG. 13). That is, the inner side wall surface 601 is shaped in a form of a curved surface that is curved in the axial direction to project relative to the flange outer wall surface 331.

Furthermore, in the present embodiment, the inner side wall surface 601 is formed to extend along the portion of the third imaginary circle C3 in the imaginary plane PL1, like in the fifth embodiment. The center O2 of the second imaginary circle C2 and the center O3 of the third imaginary circle C3 are located along the imaginary straight line Ln1, which is perpendicular to the axis Ax1 of the housing 20, when the plate portion 61 is in contact with the needle 30 (see FIG. 13).

In the ninth embodiment, the rest of the structure, which is other than the above-described point, is the same as that of the first embodiment.

As discussed above, (10) in the present embodiment, the inner side wall surface 601 of the gap forming member 60 is curved to project in the radially inner direction of the housing 20 in the cross section of the inner side wall surface 601 taken along the imaginary plane PL1, which includes the axis Ax1 of the housing 20. The outer side wall surface 602 of the gap forming member 60 is curved to project in the radially outer direction of the housing 20 in the cross section of the outer side wall surface 602 taken along the imaginary plane PL1. That is, each of the inner side wall surface 601 and the outer side wall surface 602 is curved in the axial direction. Therefore, the inner side wall surface 601 and the outer side wall surface 602 can make a line contact with the flange outer wall surface 331 or the stationary core inner wall surface 501, respectively, which are formed in the form of the cylindrical surface. Thus, even in the case where the orientation of the needle 30 is changed to tilt the axis Ax2 relative to the axis Ax1 of the housing 20 at the time of reciprocating the needle 30, it is possible to limit an increase in the slide resistance between each corresponding adjacent two of the flange 33, the gap forming member 60 and the stationary core 50, and it is also possible to limit uneven wearing of the slide surfaces of the flange 33, the gap forming member 60 and the stationary core 50. In this way, it is possible to limit the deterioration of the response of the needle 30, and it is possible to limit the unstable reciprocation of the needle 30 in the axial direction. Thus, it is possible to limit variations in the injection amount of fuel, which is injected from the fuel injection device. Furthermore, it is possible to limit generation of wear debris. Thus, it is possible to limit the operational failure that is caused by clamping of the wear debris between members, which make relative movement therebetween.

Furthermore, according to the present embodiment, similar to the eighth embodiment, the flange 33 and the gap forming member 60 can be constructed such that the outer peripheral edge corners of the end parts of the flange 33 and the outer peripheral edge corners of the end parts of the gap forming member 60 do not slide relative to the inner side wall surface 601 of the gap forming member 60 or the stationary core inner wall surface 501 of the stationary core 50, respectively. In this way, it is possible to limit the operational failure of the needle 30.

Furthermore, (11) in the present embodiment, the inner side wall surface 601 is formed to extend along the portion of the third imaginary circle C3 in the imaginary plane PL1. The outer side wall surface 602 is formed to extend along the portion of the second imaginary circle C2 in the imaginary plane PL1. The center O2 of the second imaginary circle C2 and the center O3 of the third imaginary circle C3 are located along the imaginary straight line Ln1, which is perpendicular to the axis Ax1 of the housing 20.

Thus, the slide part (Pc3), at which the flange 33 and the gap forming member 60 slide relative to each other, and the slide part (Pc2), at which the gap forming member 60 and the stationary core 50 (the bush 52) slide relative to each other, can be placed at the same location in the axial direction of the axis Ax1. Therefore, the axial reciprocation of the needle 30 can be more stably guided by the stationary core 50 (the bush 52) and the gap forming member 60.

Other Embodiments

In the first and second embodiments, when the plate portion 61 of the gap forming member 60 contacts the needle 30, the center O1 of the first imaginary circle C1 and the center O2 of the second imaginary circle C2 are located along the imaginary straight line Ln1 that is perpendicular to the axis Ax1 of the housing 20. Alternatively, in another embodiment of the present disclosure, when the plate portion 61 contacts the needle 30, each of the center O1 of the first imaginary circle C1 and the center O2 of the second imaginary circle C2 may not be located along the imaginary straight line Ln1. Furthermore, when the plate portion 61 contacts the needle 30, the maximum outer diameter part Pc1 of the flange outer wall surface 331, which has the maximum outer diameter in the flange outer wall surface 331, and the maximum outer diameter part Pc2 of the outer side wall surface 602, which has the maximum outer diameter in the outer side wall surface 602, may not be located along the imaginary straight line Ln1.

In the above embodiments, there are described the examples, in which at least one of the flange outer wall surface 331, the outer side wall surface 602, the inner side wall surface 601 or the stationary core inner wall surface 501 is formed to extend along the portion of the corresponding imaginary circle (the first imaginary circle C1, the second imaginary circle C2, the third imaginary circle C3, the fourth imaginary circle C4) in the cross section of the at least one of the flange outer wall surface 331, the outer side wall surface 602, the inner side wall surface 601 or the stationary core inner wall surface 501 taken along the imaginary plane PL1, which includes the axis Ax1 of the housing 20. Alternatively, in another embodiment of the present disclosure, at least one of the flange outer wall surface 331, the outer side wall surface 602, the inner side wall surface 601 or the stationary core inner wall surface 501 may not extend along the portion of the corresponding imaginary circle in the cross section of the at least one of the flange outer wall surface 331, the outer side wall surface 602, the inner side wall surface 601 or the stationary core inner wall surface 501 taken along the imaginary plane PL1 as long as the at least one of the flange outer wall surface 331, the outer side wall surface 602, the inner side wall surface 601 or the stationary core inner wall surface 501 is curved to project in the radially outer direction or the radially inner direction of the housing 20.

Furthermore, in another embodiment of the present disclosure, the spring seat 81, the fixing portion 82 and the tubular portion 83, i.e., the specific member 80 and the spring 73 (serving as the stationary core side urging member) may be eliminated.

Furthermore, in another embodiment of the present disclosure, the large diameter portion 311 of the needle 30 may be configured such that the outer wall of the large diameter portion 311 of the needle 30 does not slide relative to the inner wall of the nozzle tubular portion 11 of the nozzle 10. Specifically, the needle 30 may be configured such that reciprocation of the seal portion 32 side end part of the needle main body 31 is not guided by the nozzle tubular portion 11.

Furthermore, in the above embodiment, there is described the example, in which the flange 33 is formed integrally with the needle main body 31 in one piece. Alternatively, in another embodiment of the present disclosure, the flange 33 may be formed separately from the needle main body 31. For example, now, it is assumed an example where the flange 33, which is discussed in the second and third embodiments, is formed separately from the needle main body 31. In such a case, the flange 33 may be formed as follows. That is, a spherical body, which is centered at O1, is first formed by, for example, polishing. Thereafter, this spherical body is formed into a circular ring form by, for example, cutting. Then, the thus formed flange 33 is fixed to the end part of the needle main body 31, which is opposite from the seal portion 32, by press fitting or welding. In this case, the flange outer wall surface 331 can be formed with high accuracy such that the flange outer wall surface 331 extends along the first imaginary circle C1 that is centered at O1.

Furthermore, in another embodiment of the present disclosure, the stationary core main body 51 may not have the recess 511, and the stationary core 50 may not have the bush 52. In such a case, the stationary core inner wall surface 501 may be formed at the inner wall of the stationary core main body 51 located on the radially inner side of the stationary core main body 51 and may slide relative to the outer side wall surface 602 of the gap forming member 60. In such a case, the end surface of the movable core 40, which is opposite from the valve seat 14, may be configured to contact the end surface of the stationary core main body 51, which is located on the valve seat 14 side.

Furthermore, in the above embodiment, there is discussed the example where the nozzle 10 and the housing 20 (the first tubular portion 21) are formed separately. Alternatively, in another embodiment of the present disclosure, the nozzle 10 and the housing 20 (the first tubular portion 21) may be formed integrally in one piece. Furthermore, the third tubular portion 23 and the stationary core main body 51 may be formed integrally in one piece.

Furthermore, in the above embodiments, there are discussed the examples where the flange 33 is formed at the other end of the needle main body 31. Alternatively, in another embodiment of the present disclosure, the flange 33 may be formed at a radially outer side of an adjacent part of the needle main body 31, which is adjacent to the other end of the needle main body 31. In such a case, the plate portion 61 of the gap forming member 60 may not contact the flange 33 and may contact only the needle main body 31.

Furthermore, in the above embodiments, there are discussed the examples where the through-holes 43 are formed at the movable core 40. In contrast, in another embodiment of the present disclosure, the through-holes 43 may not be formed at the movable core 40. In such a case, although the moving speed of the movable core 40 at the initial stage of the energization is reduced, the excess moving speed of the movable core 40 can be limited. Thereby, this structure is advantageous in terms of limiting the overshooting of the need at the full lift time, limiting the bouncing of the movable core 40 at the full lift time, and limiting the bouncing at the valve closing time.

The application of the present disclosure should not be limited to a direct injection type gasoline engine. For example, the present disclosure may be applied to a port injection type gasoline engine or a diesel engine.

As discussed above, the present disclosure should not be limited to the above embodiments and may be embodied in various other forms without departing from the principle of the present disclosure.

The invention claimed is:

1. A fuel injection device comprising:

a nozzle that has an injection hole, through which fuel is injected, and a valve seat, which is formed around the injection hole and is shaped into a ring form;

a housing that is shaped into a tubular form and has one end connected to the nozzle, wherein the housing has a fuel passage, which is formed in an inside of the housing and is communicated with the injection hole;

a needle that has:

a needle main body, which is shaped into a rod form;

a seal portion, which is formed at one end of the needle main body such that the seal portion is contactable with the valve seat; and a flange, which is shaped into a ring form and is formed on a radially outer side of the needle main body, wherein the needle is installed such that the needle is reciprocatable in the fuel passage, and when the seal portion is lifted away from or is seated against the valve seat, the needle opens or closes the injection hole;

a movable core that is installed such that the movable core is movable relative to the needle main body and has a surface, which is opposite from the valve seat and is contactable with a surface of the flange located on a valve seat side of the flange, at which the valve seat is placed;

a stationary core that is shaped into a tubular form and is installed on an opposite side of the movable core, which is opposite from the valve seat, in the inside of the housing such that the stationary core is coaxial with the housing;

a gap forming member that has:

a plate portion that is placed on an opposite side of the needle, which is opposite from the valve seat, in an inside of the stationary core such that one end surface of the plate portion is contactable with the needle; and an extending portion that is formed to extend in a tubular form from the plate portion toward the valve seat, while an opposite end part of the extending portion, which is opposite from the plate portion, is contactable with the surface of the movable core located on a stationary core side of the movable core, at which the stationary core is placed, wherein the gap forming member is operable to form an axial gap, which is a gap defined in an axial direction between the flange and the movable core, when the plate portion and the extending portion are in contact with the needle and the movable core, respectively; and a spring that is placed on an opposite side of the gap forming member, which is opposite from the valve seat, wherein the spring is operable to urge the needle and the movable core toward the valve seat through the gap forming member; and a coil that is operable to attract the movable core toward the stationary core such that the movable core contacts the flange and drives the needle toward an opposite side of the coil, which is opposite from the valve seat, when the coil is energized, wherein:

the flange has a flange outer wall surface at an outer wall of the flange located on a radially outer side of the flange;

the stationary core has a stationary core inner wall surface at an inner wall of the stationary core located on a radially inner side of the stationary core;

the gap forming member is formed such that an inner side wall surface of the gap forming member, which is a wall surface opposed to the flange outer wall surface, is slidable relative to the flange outer wall surface, and an outer side wall surface of the gap forming member, which is a wall surface opposed to the stationary core inner wall surface, is slidable relative to the stationary core inner wall surface;

the outer side wall surface is curved to project in a radially outer direction of the housing in a vertical cross section of the outer side wall surface taken along an imaginary plane, which includes a longitudinal axis of the housing;

the stationary core is configured to limit movement of the movable core in a valve opening direction, which is a direction away from the valve seat, when an end surface of the stationary core located on a valve seat side of the stationary core abuts against an end surface of the movable core, which is opposite from the valve seat; and the end surface of the stationary core located on the valve seat side is non-contactable to an end surface of the gap forming member, which is opposite from the valve seat, when the movement of the movable core in the valve opening direction is limited by the stationary core.

2. The fuel injection device according to claim 1, wherein:

each of the flange outer wall surface and the outer side wall surface is curved to project in the radially outer direction of the housing in a cross section of each of the flange outer wall surface and the outer side wall surface taken along the imaginary plane;

the flange outer wall surface is formed to extend along a portion of a first imaginary circle in the imaginary plane;

the outer side wall surface is formed to extend along a portion of a second imaginary circle in the imaginary plane; and a center of the first imaginary circle and a center of the second imaginary circle are located along an imaginary straight line, which is perpendicular to the axis of the housing, when the plate portion is in contact with the needle.

3. The fuel injection device according to claim 1, wherein:

the flange outer wall surface is curved to project in the radially outer direction of the housing in a cross section of the flange outer wall surface taken along the imaginary plane;

the flange outer wall surface is formed to extend along a portion of a first imaginary circle in the imaginary plane; and a center of the first imaginary circle is located along the axis of the housing.

4. The fuel injection device according to claim 1, wherein:

the outer side wall surface is curved to project in the radially outer direction of the housing in the cross section of the outer side wall surface taken along the imaginary plane;

the outer side wall surface is formed to extend along a portion of a second imaginary circle in the imaginary plane; and a center of the second imaginary circle is located along the axis of the housing.

5. The fuel injection device according to claim 1, wherein:

each of the flange outer wall surface and the outer side wall surface is curved to project in the radially outer direction of the housing in a cross section of each of the flange outer wall surface and the outer side wall surface taken along the imaginary plane; and a maximum outer diameter part of the flange outer wall surface, which has a maximum outer diameter in the flange outer wall surface, and a maximum outer diameter part of the outer side wall surface, which has a maximum outer diameter in the outer side wall surface, are located along an imaginary straight line, which is perpendicular to the axis of the housing, when the plate portion is in contact with the needle.

6. The fuel injection device according to claim 1, wherein at least one of the flange outer wall surface, the inner side wall surface, the outer side wall surface or the stationary core inner wall surface is formed to extend along a portion of an imaginary circle in the imaginary plane in a cross section of the at least one of the flange outer wall surface, the inner side wall surface, the outer side wall surface or the stationary core inner wall surface taken along the imaginary plane.

7. The fuel injection device according to claim 1, wherein:

the stationary core includes:

a stationary core main body that is shaped into a tubular form; and a bush that is installed at an inside of an end part of the stationary core main body located on the valve seat side of the stationary core;

when the end surface of the movable core, which is opposite from the valve seat, collides against an end surface of the bush located on the valve seat side of the stationary core, the movement of the movable core in the valve opening direction is limited.

8. A fuel injection device comprising:

a nozzle that has an injection hole, through which fuel is injected, and a valve seat, which is formed around the injection hole and is shaped into a ring form;

a housing that is shaped into a tubular form and has one end connected to the nozzle, wherein the housing has a fuel passage, which is formed in an inside of the housing and is communicated with the injection hole;

a needle that has:

a needle main body, which is shaped into a rod form;

a seal portion, which is formed at one end of the needle main body such that the seal portion is contactable with the valve seat; and a flange, which is shaped into a ring form and is formed on a radially outer side of the needle main body, wherein the needle is installed such that the needle is reciprocatable in the fuel passage, and when the seal portion is lifted away from or is seated against the valve seat, the needle opens or closes the injection hole;

a movable core that is installed such that the movable core is movable relative to the needle main body and has a surface, which is opposite from the valve seat and is contactable with a surface of the flange located on a valve seat side of the flange, at which the valve seat is placed;

a stationary core that is shaped into a tubular form and is installed on an opposite side of the movable core, which is opposite from the valve seat, in the inside of the housing such that the stationary core is coaxial with the housing;

a gap forming member that has:

a plate portion that is placed on an opposite side of the needle, which is opposite from the valve seat, in an inside of the stationary core such that one end surface of the plate portion is contactable with the needle; and an extending portion that is formed to extend in a tubular form from the plate portion toward the valve seat, while an opposite end part of the extending portion, which is opposite from the plate portion, is contactable with the surface of the movable core located on a stationary core side of the movable core, at which the stationary core is placed, wherein the gap forming member is operable to form an axial gap, which is a gap defined in an axial direction between the flange and the movable core, when the plate portion and the extending portion are in contact with the needle and the movable core, respectively; and a spring that is placed on an opposite side of the gap forming member, which is opposite from the valve seat, wherein the spring is operable to urge the needle and the movable core toward the valve seat through the gap forming member; and a coil that is operable to attract the movable core toward the stationary core such that the movable core contacts the flange and drives the needle toward an opposite side of the coil, which is opposite from the valve seat, when the coil is energized, wherein:

the flange has a flange outer wall surface at an outer wall of the flange located on a radially outer side of the flange;

the stationary core has a stationary core inner wall surface at an inner wall of the stationary core located on a radially inner side of the stationary core;

the gap forming member is formed such that an inner side wall surface of the gap forming member, which is a wall surface opposed to the flange outer wall surface, is slidable relative to the flange outer wall surface, and an outer side wall surface of the gap forming member, which is a wall surface opposed to the stationary core inner wall surface, is slidable relative to the stationary core inner wall surface;

the outer side wall surface is curved to project in a radially outer direction of the housing in a vertical cross section of the outer side wall surface taken along an imaginary plane, which includes a longitudinal axis of the housing;

the stationary core is configured to limit movement of the movable core in a valve opening direction, which is a direction away the valve seat, through an end surface of the stationary core located on an injection hole side of the stationary core;

each of the flange outer wall surface and the outer side wall surface is curved to project in the radially outer direction of the housing in a cross section of each of the flange outer wall surface and the outer side wall surface taken along the imaginary plane;

the flange outer wall surface is formed to extend along a portion of a first imaginary circle in the imaginary plane;

the outer side wall surface is formed to extend along a portion of a second imaginary circle in the imaginary plane; and a center of the first imaginary circle and a center of the second imaginary circle are located along an imaginary straight line, which is perpendicular to the axis of the housing, when the plate portion is in contact with the needle.

9. A fuel injection device comprising:

a nozzle that has an injection hole, through which fuel is injected, and a valve seat, which is formed around the injection hole and is shaped into a ring form;

a housing that is shaped into a tubular form and has one end connected to the nozzle, wherein the housing has a fuel passage, which is formed in an inside of the housing and is communicated with the injection hole;

a needle that has:

a needle main body, which is shaped into a rod form;

a seal portion, which is formed at one end of the needle main body such that the seal portion is contactable with the valve seat; and a flange, which is shaped into a ring form and is formed on a radially outer side of the needle main body, wherein the needle is installed such that the needle is reciprocatable in the fuel passage, and when the seal portion is lifted away from or is seated against the valve seat, the needle opens or closes the injection hole;

a movable core that is installed such that the movable core is movable relative to the needle main body and has a surface, which is opposite from the valve seat and is contactable with a surface of the flange located on a valve seat side of the flange, at which the valve seat is placed;

a stationary core that is shaped into a tubular form and is installed on an opposite side of the movable core, which is opposite from the valve seat, in the inside of the housing such that the stationary core is coaxial with the housing;

a gap forming member that has:

a plate portion that is placed on an opposite side of the needle, which is opposite from the valve seat, in an inside of the stationary core such that one end surface of the plate portion is contactable with the needle; and an extending portion that is formed to extend in a tubular form from the plate portion toward the valve seat, while an opposite end part of the extending portion, which is opposite from the plate portion, is contactable with the surface of the movable core located on a stationary core side of the movable core, at which the stationary core is placed, wherein the gap forming member is operable to form an axial gap, which is a gap defined in an axial direction between the flange and the movable core, when the plate portion and the extending portion are in contact with the needle and the movable core, respectively; and a spring that is placed on an opposite side of the gap forming member, which is opposite from the valve seat, wherein the spring is operable to urge the needle and the movable core toward the valve seat through the gap forming member; and a coil that is operable to attract the movable core toward the stationary core such that the movable core contacts the flange and drives the needle toward an opposite side of the coil, which is opposite from the valve seat, when the coil is energized, wherein:

the flange has a flange outer wall surface at an outer wall of the flange located on a radially outer side of the flange;

the stationary core has a stationary core inner wall surface at an inner wall of the stationary core located on a radially inner side of the stationary core;

the gap forming member is formed such that an inner side wall surface of the gap forming member, which is a wall surface opposed to the flange outer wall surface, is slidable relative to the flange outer wall surface, and an outer side wall surface of the gap forming member, which is a wall surface opposed to the stationary core inner wall surface, is slidable relative to the stationary core inner wall surface;

the outer side wall surface is curved to project in a radially outer direction of the housing in a vertical cross section of the outer side wall surface taken along an imaginary plane, which includes a longitudinal axis of the housing;

the stationary core is configured to limit movement of the movable core in a valve opening direction, which is a direction away the valve seat, through an end surface of the stationary core located on an injection hole side of the stationary core;

each of the flange outer wall surface and the outer side wall surface is curved to project in the radially outer direction of the housing in a cross section of each of the flange outer wall surface and the outer side wall surface taken along the imaginary plane; and a maximum outer diameter part of the flange outer wall surface, which has a maximum outer diameter in the flange outer wall surface, and a maximum outer diameter part of the outer side wall surface, which has a maximum outer diameter in the outer side wall surface, are located along an imaginary straight line, which is perpendicular to the axis of the housing, when the plate portion is in contact with the needle.

* * * * *